US006559626B2

(12) United States Patent
Horie

(10) Patent No.: US 6,559,626 B2
(45) Date of Patent: May 6, 2003

(54) VOLTAGE REGULATOR

(75) Inventor: Masakiyo Horie, Gamagoori (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/985,355

(22) Filed: Nov. 2, 2001

(65) Prior Publication Data

US 2002/0057079 A1 May 16, 2002

(30) Foreign Application Priority Data

Nov. 13, 2000 (JP) ..... 2000-345393

(51) Int. Cl.[7] ..... G05F 1/40
(52) U.S. Cl. ..... 323/282
(58) Field of Search ..... 323/268, 271, 323/282, 284, 285

(56) References Cited

U.S. PATENT DOCUMENTS 5,373,225 A * 12/1994 Poletto et al. ..... 323/282
5,510,697 A * 4/1996 Dormer ..... 323/273
5,828,206 A * 10/1998 Hosono et al. ..... 323/273
5,859,757 A 1/1999 Hanafusa et al.

FOREIGN PATENT DOCUMENTS

JP A-10-111722 4/1998

* cited by examiner

*Primary Examiner*—Matthew Nguyen
(74) *Attorney, Agent, or Firm*—Posz & Bethards, PLC

(57) ABSTRACT

A voltage detection circuit detects a regulator output voltage. A current detection circuit detects a regulator output current. A first amplifier circuit generates a voltage error signal in response to a command output voltage level indicative of a target value of the regulator output voltage, and in response to the detected regulator output voltage. A second amplifier circuit generates a current limiting signal in response to a command limit current level indicative of a limit value of the regulator output current, and in response to the detected regulator output current. A device controls the regulator output current in response to a control current. A first transistor provided in a flow path for the control current is driven in response to the voltage error signal. A second transistor provided in the flow path and connected in series with the first transistor is driven in response to the current limiting signal.

19 Claims, 13 Drawing Sheets

VOLTAGE REGULATOR

BACKGROUND OF THE INVENTION

1. Field of the Invention

This invention relates to a voltage regulator having an overcurrent protection circuit.

2. Description of the Related Art

It is known to provide a voltage regulator with an overcurrent protection circuit. In the event that the resistance of a load connected with the voltage regulator drops and therefore the voltage regulator is overloaded, the overcurrent protection circuit prevents a voltage-regulator output current from excessively increasing. The prevention of the occurrence of such an overcurrent protects the voltage regulator and the load.

Overcurrent protection circuits are of a constant-current type, a current reduction type, and a current cut-off type. The overcurrent protection circuit of the constant-current type holds a voltage-regulator output current at an acceptable constant level when a related voltage regulator is overloaded. The overcurrent protection circuit of the current reduction type decreases a voltage-regulator output current from a normal level when a related voltage regulator is overloaded. The overcurrent protection circuit of the current cut-off type interrupts a voltage-regulator output current when a related voltage regulator is overloaded.

U.S. Pat. No. 5,859,757 corresponding to Japanese patent application publication number 10-111722 discloses an output driving circuit for use in a DC stabilized power supply circuit. In U.S. Pat. No. 5,859,757, the DC stabilized power supply circuit includes an output transistor which feeds an output current to a load in response to a drive current Id. The output voltage of the DC stabilized power supply circuit, that is, the voltage across the load, is divided by a resistor network into a feedback voltage Vadj. The DC stabilized power supply circuit includes an error amplifier for generating and outputting a voltage VA representing the error of the feedback voltage Vadj from a reference voltage Vref. A base drive circuit connected between the error amplifier and the output transistor controls the drive current Id in response to the error voltage VA. The drive current Id flows through a sensing resistor. The voltage VR21 across the sensing resistor depends on the drive current Id, and indicates the output current fed to the load. A short-circuit overcurrent protecting circuit detects whether or not the output current to the load increases into an overcurrent range on the basis of the voltage VR21 across the sensing resistor. The short-circuit overcurrent protecting circuit detects whether or not the load is short-circuited on the basis of the feedback voltage Vadj. The short-circuit overcurrent protecting circuit is connected with the junction between the error amplifier and the base drive circuit. The short-circuit overcurrent protecting circuit can force the error voltage VA to drop. When the voltage VR21 across the sensing resistor exceeds a prescribed level, that is, when the output current to the load increases into the overcurrent range, the short-circuit overcurrent protecting circuit forcedly decreases the error voltage VA. The decrease in the error voltage VA causes a reduction in the drive current Id. As a result, the output current to the load decreases below the overcurrent range. When the feedback voltage Vadj drops below a given level, that is, when the load is short-circuited, the short-circuit overcurrent protecting circuit forcedly decreases the error voltage VA. As a result of the decrease in the error voltage VA, the drive current Id and also the output current to the load are limited to within acceptable ranges.

SUMMARY OF THE INVENTION

It is an object of this invention to provide a stable and power-efficient voltage regulator having an overcurrent protection circuit.

A first aspect of this invention provides a voltage regulator for converting an input voltage into a regulated voltage equal to a command level, and outputting the regulated voltage. The voltage regulator comprises a voltage detection circuit for detecting a regulator output voltage; a current detection circuit for detecting a regulator output current; a first amplifier circuit for generating a voltage error signal in response to a command output voltage level indicative of a target value of the regulator output voltage, and in response to the regulator output voltage detected by the voltage detection circuit; a second amplifier circuit for generating a current limiting signal in response to a command limit current level indicative of a limit value of the regulator output current, and in response to the regulator output current detected by the current detection circuit; means for controlling the regulator output current in response to a control current; a first transistor provided in a flow path for the control current, and being driven in response to the voltage error signal generated by the first amplifier circuit; and a second transistor provided in the flow path and connected in series with the first transistor, the second transistor being driven in response to the current limiting signal generated by the second amplifier circuit.

A second aspect of this invention is based on the first aspect thereof, and provides a voltage regulator wherein the controlling means comprises a power-supply input terminal, a power-supply output terminal, and an output transistor connected between the power-supply input terminal and the power-supply output terminal, and wherein the flow path includes a flow path for a base current through the output transistor.

A third aspect of this invention is based on the first aspect thereof, and provides a voltage regulator wherein the controlling means comprises a power-supply input terminal, a power-supply output terminal, an output transistor connected between the power-supply input terminal and the power-supply output terminal, and a drive transistor for driving the output transistor, and wherein the flow path includes a flow path for a base current through the drive transistor.

A fourth aspect of this invention is based on the second aspect thereof, and provides a voltage regulator wherein the current detection circuit comprises a resistor connected in series with the output transistor.

A fifth aspect of this invention is based on the fourth aspect thereof, and provides a voltage regulator wherein the second amplifier circuit comprises a differential amplifier circuit having first and second input terminals, the first input terminal receiving a voltage across the resistor, the second input terminal receiving a reference voltage corresponding to the command limit current level.

A sixth aspect of this invention provides a voltage regulator for converting an input voltage fed to a power-supply input terminal into a regulated voltage equal to a command level, and outputting the regulated voltage via a power-supply output terminal. The voltage regulator comprises a voltage detection circuit for detecting a regulator output voltage; a current detection circuit for detecting a regulator output current; a first amplifier circuit for generating a voltage error signal in response to a command output voltage level indicative of a target value of the regulator output voltage, and in response to the regulator output voltage detected by the voltage detection circuit; a second amplifier circuit for generating a current limiting signal in response to a command limit current level indicative of a limit value of the regulator output current, and in response to the regulator output current detected by the current detection circuit; a current feed path connected between the power-supply input terminal and the power-supply output terminal; a first transistor provided in the current feed path, and being driven in response to the voltage error signal generated by the first amplifier circuit; and a second transistor provided in the current feed path and being connected in series with the first transistor, the second transistor being driven in response to the current limiting signal generated by the second amplifier circuit.

A seventh aspect of this invention is based on the sixth aspect thereof, and provides a voltage regulator wherein the current detection circuit comprises a resistor connected in series with the first and second transistors.

An eighth aspect of this invention is based on the seventh aspect thereof, and provides a voltage regulator wherein the second amplifier circuit comprises a differential amplifier circuit having first and second input terminals, the first input terminal receiving a voltage across the resistor, the second input terminal receiving a reference voltage corresponding to the command limit current level.

A ninth aspect of this invention is based on the eighth aspect thereof, and provides a voltage regulator further comprising a voltage dividing circuit connected between the power-supply input terminal and a ground terminal for generating the reference voltage.

A tenth aspect of this invention is based on the fifth aspect thereof, and provides a voltage regulator further comprising a constant-voltage circuit connected with the power-supply input terminal for generating the reference voltage.

An eleventh aspect of this invention is based on the first aspect thereof, and provides a voltage regulator wherein the voltage detection circuit comprises a voltage dividing circuit connected between a power-supply output terminal and a ground terminal for generating a division-result voltage, and wherein the first amplifier circuit comprises a differential amplifier circuit having first and second input terminals, the first input terminal receiving the division-result voltage, the second input terminal receiving a reference voltage corresponding to the command output voltage level.

A twelfth aspect of this invention is based on the first aspect thereof, and provides a voltage regulator wherein the first and second transistors are of a same conductivity type.

A thirteenth aspect of this invention is based on the fourth aspect thereof, and provides a voltage regulator wherein the second amplifier circuit comprises a differential amplifier circuit receiving a voltage across the resistor, and means for generating an offset voltage in the differential amplifier, the offset voltage corresponding to the command limit current level.

A fourteenth aspect of this invention provides a voltage regulator comprising a power feed line for transmitting electric power toward a load; an output transistor provided in the power feed line and having a base; a control line extending from the base of the transistor for transmitting a base current from the output transistor; first and second control transistors connected in series and provided in the control line; first means for detecting a voltage of the electric power transmitted toward the load; second means for controlling the first control transistor to control the output-transistor base current in response to the voltage detected by the first means; third means for detecting a current of the electric power transmitted toward the load; and fourth means for controlling the second control transistor to control the output-transistor base current in response to the current detected by the third means.

A fifteenth aspect of this invention provides a voltage regulator comprising a power feed line for transmitting electric power toward a load; first and second control transistors connected in series and provided in the power feed line; first means for detecting a voltage of the electric power transmitted toward the load; second means for controlling the first control transistor to control the electric power transmitted toward the load in response to the voltage detected by the first means; third means for detecting a current of the electric power transmitted toward the load; and fourth means for controlling the second control transistor to control the electric power transmitted toward the load in response to the current detected by the third means.

DETAILED DESCRIPTION OF THE INVENTION

Prior-art voltage regulators will be explained below for a better understanding of this invention.

Figure 1:
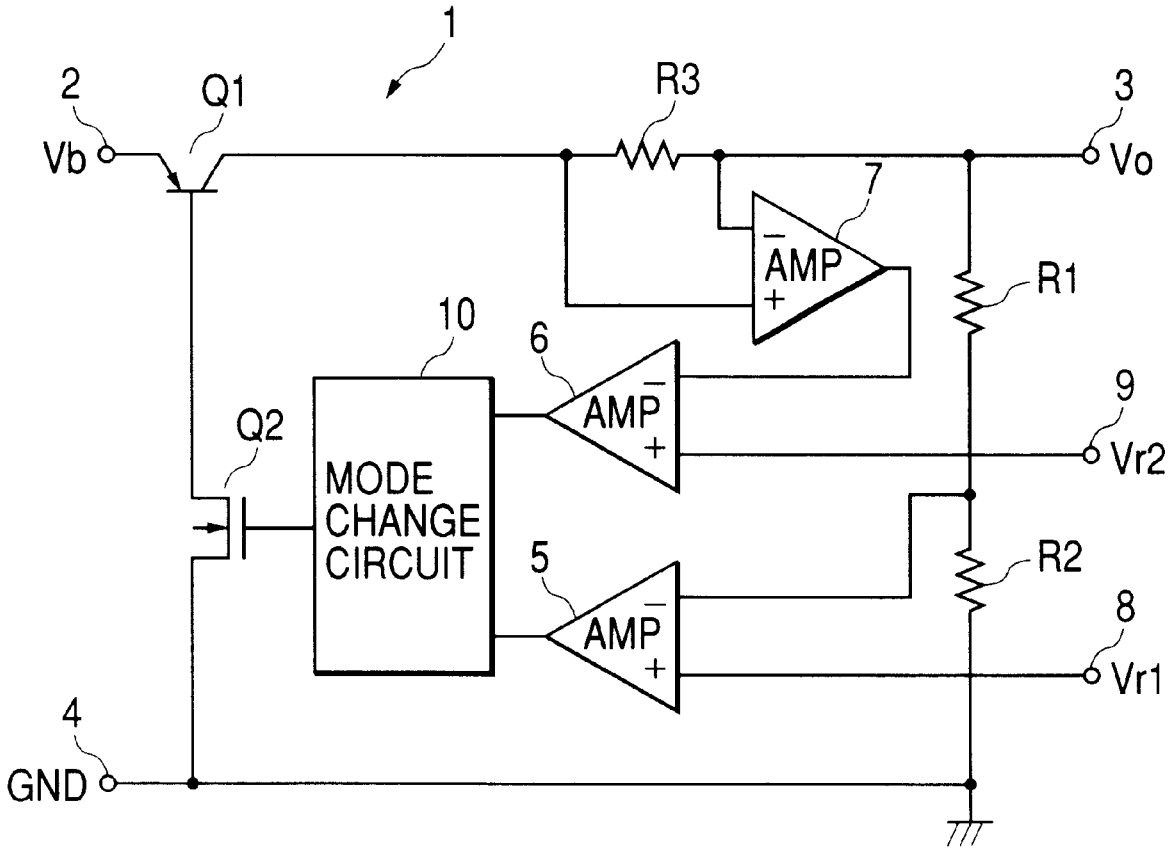
FIG. 1 PRIOR ART
FIG. 1 is a diagram of a first prior-art voltage regulator.

FIG. 1 shows a first prior-art voltage regulator 1 which is provided with an overcurrent protection circuit of the constant-current type. The prior-art voltage regulator 1 includes an output transistor Q1 connected between a power-supply input terminal 2 and a power-supply output terminal 3. A transistor Q2 is connected between a ground terminal 4 and the base of the output transistor Q1. The prior-art voltage regulator 1 also includes a voltage dividing circuit composed of resistors R1 and R2 connected in series between the power-supply output terminal 3 and the ground terminal 4. The voltage dividing circuit acts to divide the regulator output voltage Vo into a division-result voltage which appears at the junction between the resistors R1 and R2, and which is an indication of the regulator output voltage Vo. The prior-art voltage regulator 1 further includes a differential amplifier circuit 5 receiving the division-result voltage from the voltage dividing circuit. The differential amplifier circuit 5 receives a reference voltage Vr1 via an input terminal 8. The differential amplifier circuit 5 generates and outputs a signal representing the error of the division-result voltage from the reference voltage Vr1, that is, the error of the regulator output voltage Vo from a reference level.

The prior-art voltage regulator 1 also includes a resistor R3 and differential amplifier circuits 6 and 7. The resistor R3 is interposed in the connection between the output transistor Q1 and the power-supply output terminal 3. The voltage across the resistor R3 is proportional to the regulator output current. The differential amplifier circuit 7 amplifies the voltage across the resistor R3. The differential amplifier circuit 7 outputs a voltage representing the regulator output current. The differential amplifier circuit 6 receives the output voltage from the differential amplifier circuit 7. The differential amplifier circuit 6 receives a reference voltage Vr2 via an input terminal 9. The reference voltage Vr2 corresponds to a command limit current level. The differential amplifier circuit 6 generates and outputs a signal representing the error between the output voltage from the differential amplifier circuit 7 and the reference voltage Vr2, that is, the error of the regulator output current from the command limit current level.

The prior-art voltage regulator 1 further includes a mode change circuit 10 connected among the output terminal of the differential amplifier circuit 5, the output terminal of the differential amplifier circuit 6, and the gate of the transistor Q2. The mode change circuit 10 controls the transistor Q2 in response to the output signals from the differential amplifier circuits 5 and 6. Operation of the prior-art voltage regulator 1 is changed by the mode change circuit 10 between a normal mode and an overload mode. During the normal mode of operation, the mode change circuit 10 causes the control of the transistor Q2 to be responsive mainly to the output signal from the differential amplifier circuit 5. In this case, the prior-art voltage regulator 1 implements constant-voltage control by which the regulator output voltage Vo is regulated at the reference level. During the overload mode of operation, the mode change circuit 10 causes the control of the transistor Q2 to be responsive mainly to the output signal from the differential amplifier circuit 6. In this case, the prior-art voltage regulator 1 implements constant-current control by which the regulator output current is held at the command limit current level.

The mode change circuit 10 is of a complicated structure designed to stabilize operation change between the normal mode and the overload mode when the regulator output current is close to the command limit current level. The mode change circuit 10 forms a portion of a feedback loop in the prior-art voltage regulator 1. The mode change circuit 10 includes a plurality of transistors which cause a considerable signal phase delay reducing the regulator operation stability.

Figure 2:
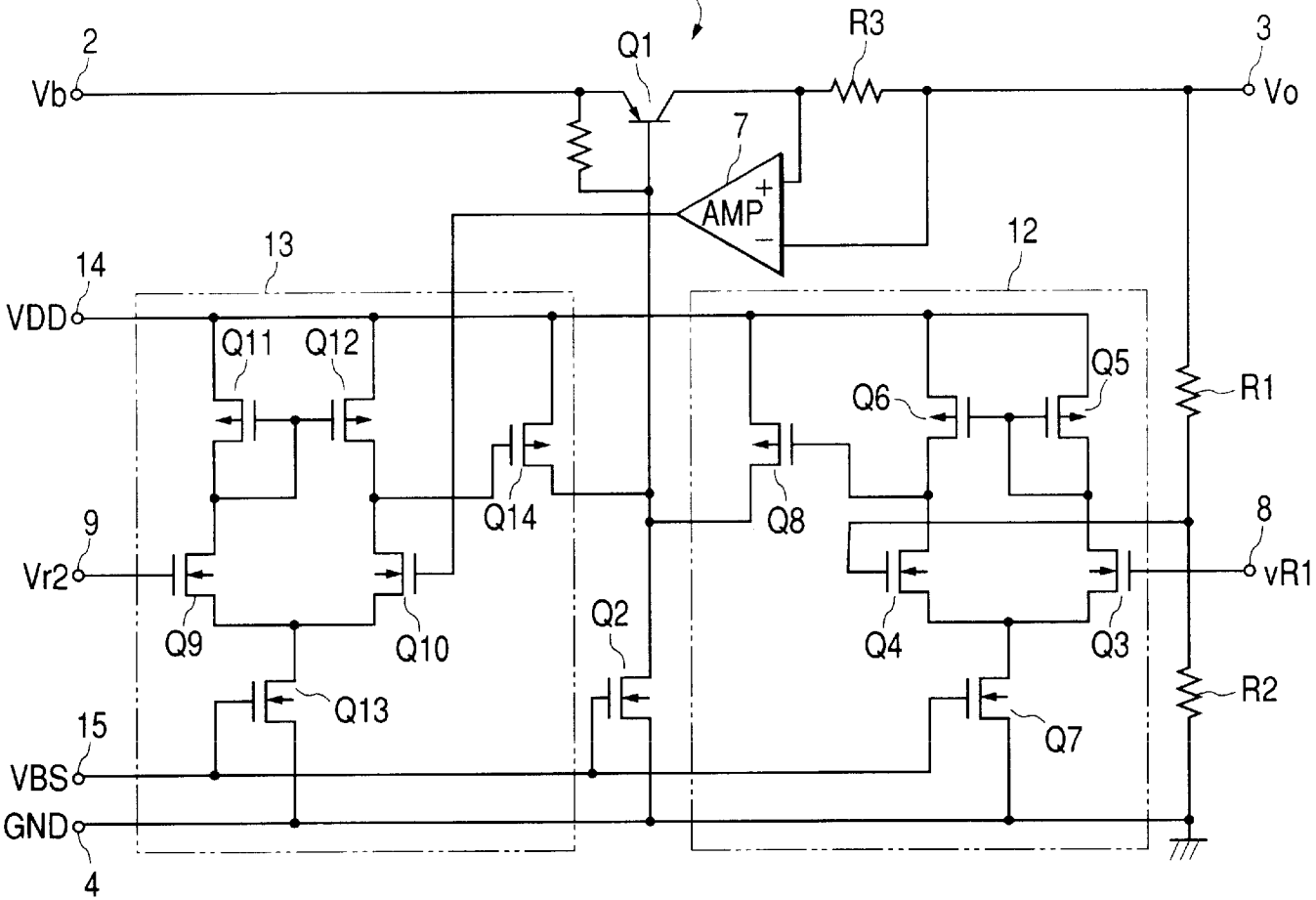
FIG. 2 PRIOR ART
FIG. 2 is a schematic diagram of a second prior-art voltage regulator.

FIG. 2 shows a second prior-art voltage regulator 11 which is a modification of the first prior-art voltage regulator 1 (see FIG. 1). As shown in FIG. 2, the prior-art voltage regulator 11 includes operational amplifiers 12 and 13. The operational amplifier 12 corresponds to the differential amplifier circuit 5 in FIG. 1. The operational amplifier 13 corresponds to the differential amplifier circuit 6 in FIG. 1. The operational amplifier 12 includes combination of transistors Q3–Q8. The operational amplifier 13 includes a combination of transistors Q9–Q14. The transistor Q8 in the operational amplifier 12 and the transistor Q14 in the operational amplifier 13 are connected in parallel between a control power supply terminal 14 and the base of an output transistor Q1. A bias voltage VBS is applied via a terminal 15 to the base of a transistor Q2 and also the bases of the transistor Q7 and Q13.

In the prior-art voltage regulator 11, a constant drain current determined by the bias voltage VBS flows through the transistor Q2. The drain current through the transistor Q2 is equal to the sum of a base current through the output transistor Q1, a drain current through the transistor Q8, and a drain current through the transistor Q14. As the drain current through the transistor Q8 or the drain current through the transistor Q14 varies, the base current through the output transistor Q1 varies correspondingly. The bias voltage VBS is set so that the drain current through the transistor Q2 will be equal to or greater than a maximum value of the base current through the output transistor Q1 which is necessary for the drive thereof.

Figure 3:
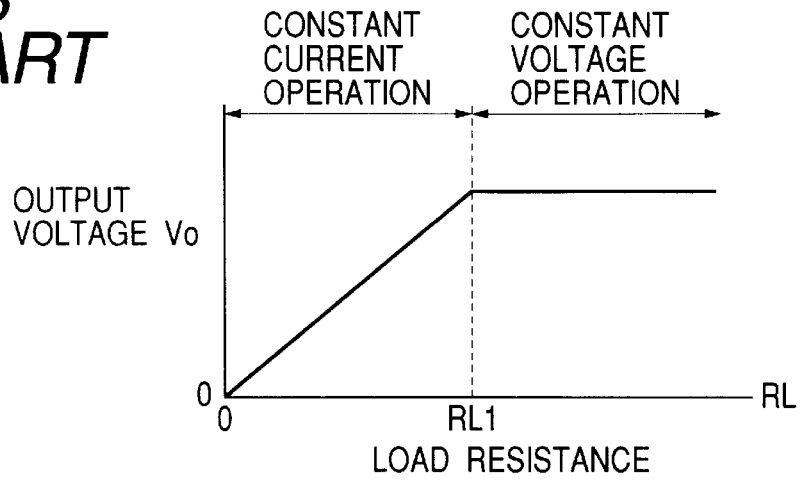
FIG. 3 PRIOR ART
FIG. 3 is a diagram of the relation between a load resistance and a regulator output voltage in the prior-art voltage regulator of FIG. 2.
Figure 4:
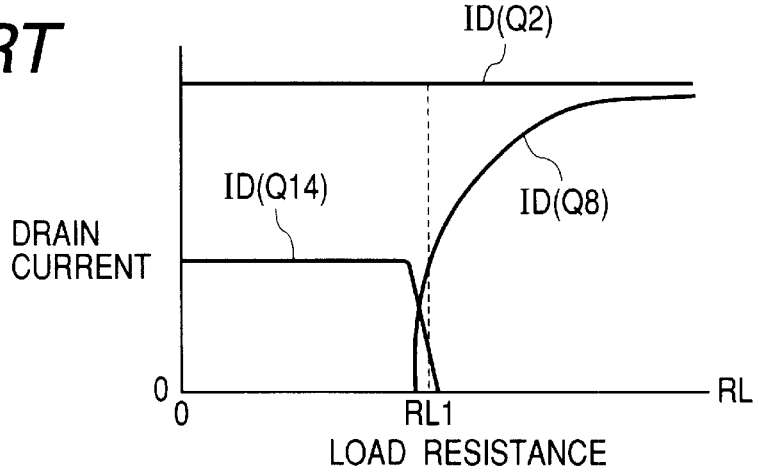
FIG. 4 PRIOR ART
FIG. 4 is a diagram of the relation among a load resistance and drain currents in the prior-art voltage regulator of FIG. 2.
Figure 5:
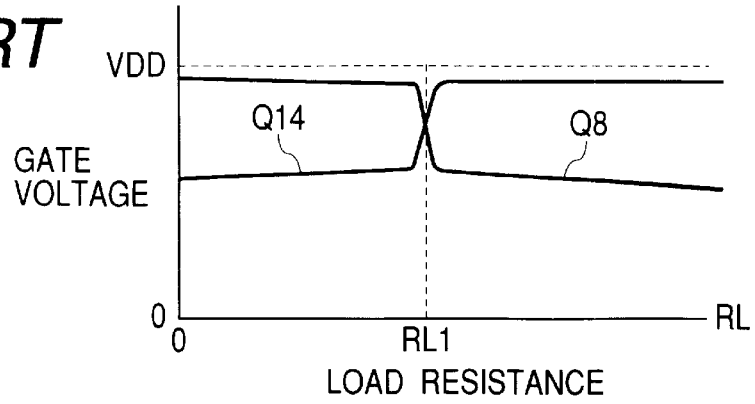
FIG. 5 PRIOR ART
FIG. 5 is a diagram of the relation among a load resistance and voltages at the gates of transistors in the prior-art voltage regulator of FIG. 2.

As shown in FIG. 3, the output voltage Vo of the prior-art voltage regulator 11 varies in accordance with a change in the resistance RL of a load connected thereto. As shown in FIG. 4, the drain current ID(Q8) through the transistor Q8 and the drain current ID(Q14) through the transistor Q14 depend on the resistance RL of the load. On the other hand, the drain current ID(Q2) through the transistor Q2 remains constant independent of the resistance RL of the load. As shown in FIG. 5, the voltage at the gate of the transistor Q8 and the voltage at the gate of the transistor Q14 depend on the resistance RL of the load.

When the resistance RL of the load is greater than a specific value RL1, that is, when the regulator output current is smaller than a command limit current level, the output voltage from a differential amplifier circuit 7 is lower than a reference voltage Vr2 so that the transistor Q14 in the operational amplifier 13 is in its off state. At this time, the operational amplifier 12 controls the drain current through the transistor Q8 and hence the base current through the output transistor Q1 so that a division-result voltage generated by a voltage dividing circuit of resistors R1 and R2 will be equal to a reference voltage Vr1. As a result, the prior-art voltage regulator 11 implements constant-voltage control by which the regulator output voltage Vo is equalized to a reference level corresponding to the reference voltage Vr1.

When the resistance RL of the load is smaller than the specific value RL1, that is, when the prior-art voltage regulator 11 is overloaded so that the regulator output current may exceed the command limit current level, the operational amplifier 13 controls the drain current through the transistor Q14 and hence the base current through the output transistor Q1 to equalize the output voltage from the differential amplifier circuit 7 to the reference voltage Vr2.

As a result, the regulator output current which flows through the output transistor Q1 is limited to the command limit current level, and the prior-art voltage regulator 11 implements constant-current control. At this time, the regulator output voltage Vo drops below the reference level, and the transistor Q8 in the operational amplifier 12 is in its off state.

In the prior-art voltage regulator 11, the drain current through the transistor Q2 is equal to or greater than the maximum value of the base current through the output transistor Q1. The drain current through the transistor Q2 enters a ground terminal 4, being wastefully dissipated. Therefore, the prior-art voltage regulator 11 is relatively low in power efficiency.

There is a known IC voltage regulator including an output transistor connected between a power-supply input terminal and a power-supply output terminal, a transistor for drawing an unnecessary current from the power-supply output terminal under constant-voltage control, and a transistor for drawing an unnecessary current from the power-supply output terminal under constant-current control. The currents drawn are wastefully dissipated. Therefore, the known IC voltage regulator is relatively low in power efficiency.

First Embodiment

Figure 6:
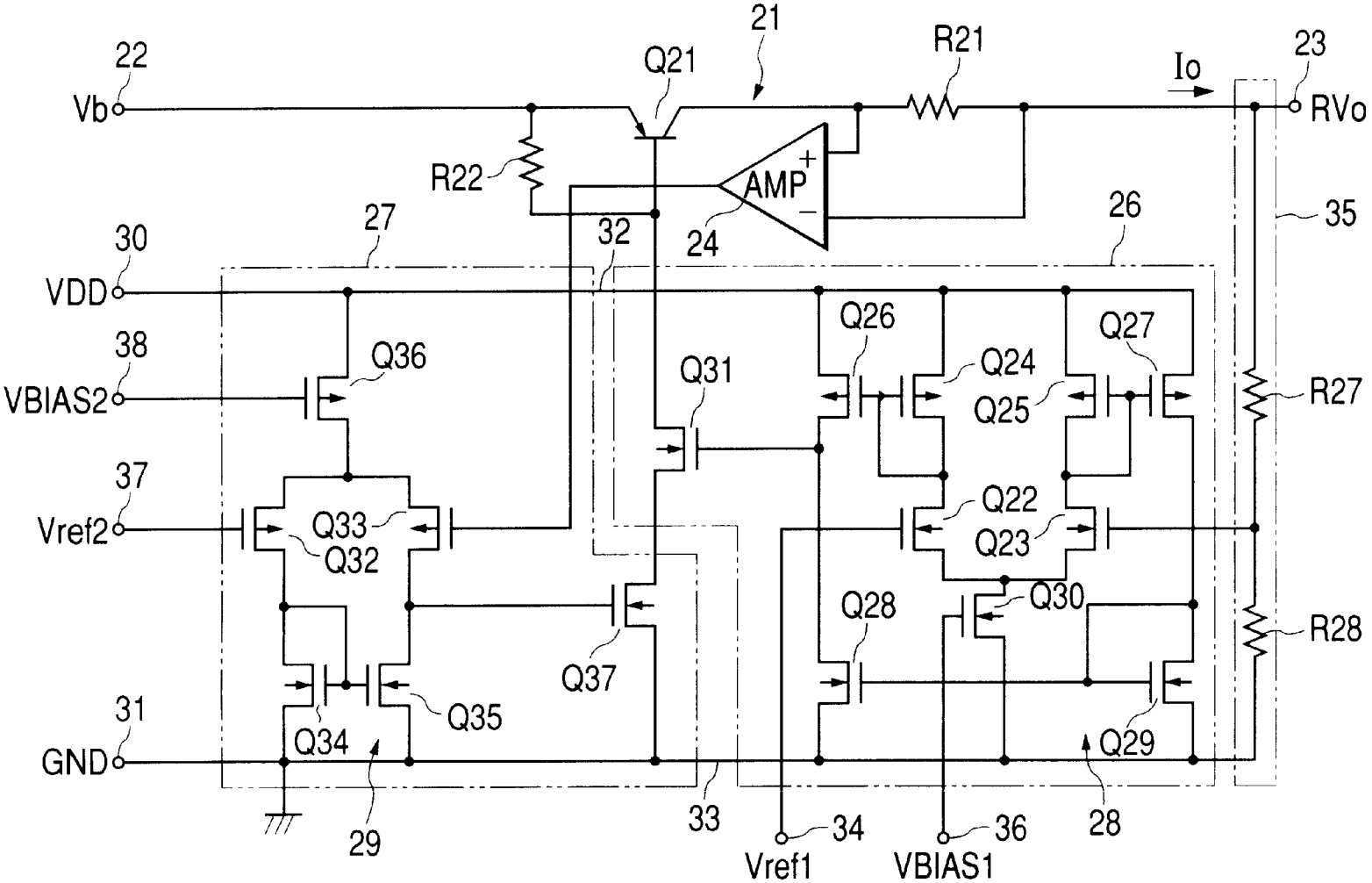
FIG. 6 is a schematic diagram of a voltage regulator according to a first embodiment of this invention.

FIG. 6 shows a voltage regulator 21 according to a first embodiment of this invention. The voltage regulator 21 has an overcurrent protection function of the constant-current type. For example, the voltage regulator 21 is designed as a power supply IC in an electronic control unit for controlling an engine.

As shown in FIG. 6, the voltage regulator 21 includes a power-supply input terminal 22, a power-supply output terminal 23, an output transistor Q21 of the PNP type, and a resistor R21. The emitter of the output transistor Q21 is connected to the power-supply input terminal 22. The collector of the output transistor Q21 is connected via the resistor R21 to the power-supply output terminal 23. The resistor R21 corresponds to a current sensing resistor. A resistor R22 is connected between the emitter of the output transistor Q21 and the base thereof.

It should be noted that the output transistor Q21 and the resistors R21 and R22 may be located outside an IC package.

The junction between the resistor R21 and the collector of the output transistor Q21 is connected to a non-inverting input terminal of an amplifier circuit 24. The junction between the resistor R21 and the power-supply output terminal 23 is connected to an inverting input terminal of the amplifier circuit 24. Accordingly, the voltage across the resistor R21 is applied to the input side of the amplifier circuit 24.

Figure 7:
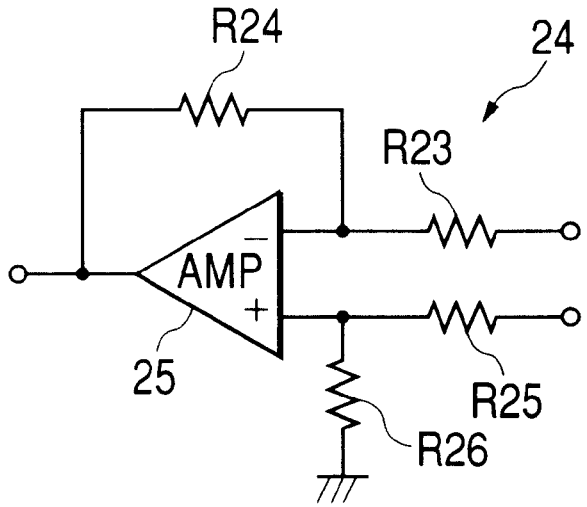
FIG. 7 is a schematic diagram of an amplifier circuit in FIG. 6.

As shown in FIG. 7, the amplifier circuit 24 includes a differential amplifier 25 and resistors R23, R24, R25, and R26. The inverting input terminal of the differential amplifier 25 is connected via the resistor R23 to the junction between the resistor R21 and the power-supply output terminal 23. The non-inverting input terminal of the differential amplifier 25 is connected via the resistor R25 to the junction between the resistor R21 and the collector of the output transistor Q21. The non-inverting input terminal of the differential amplifier 25 is grounded via the resistor R26. The resistor R24 is connected between the inverting input terminal of the differential amplifier 25 and the output terminal thereof. The output terminal of the differential amplifier 25 constitutes the output terminal of the amplifier circuit 24.

With reference back to FIG. 6, the voltage regulator 21 includes operational amplifiers 26 and 27 for controlling the output transistor Q21. The operational amplifier 26 is composed of a differential amplifier circuit 28 and a transistor Q31. The differential amplifier circuit 28 corresponds to a first amplifier circuit. The differential amplifier circuit 28 has a combination of transistors Q22–Q30. The transistor Q31 corresponds to a first transistor. The transistor Q31 is controlled by the differential amplifier circuit 28. The operational amplifier 27 is composed of a differential amplifier circuit 29 and a transistor Q37. The differential amplifier circuit 29 corresponds to a second amplifier circuit. The differential amplifier circuit 29 has a combination of transistors Q32–Q36. The transistor Q37 corresponds to a second transistor. The transistor Q37 is controlled by the differential amplifier circuit 29. The operational amplifiers 26 and 27 are connected via a power feed line 32 to a positive power supply terminal 30. The operational amplifiers 26 and 27 are connected via a power feed line 33 to a negative power supply terminal 31. A power supply voltage VDD is applied between the positive and negative power supply terminals 30 and 31. The negative power supply terminal 31 is subjected to a ground potential. Thus, the negative power supply terminal 31 is also referred to as the ground terminal 31, and the power feed line 33 is also referred to as the ground line 33. The power supply voltage VDD is fed to the operational amplifiers 26 and 27 via the positive and negative power supply terminals 30 and 31 and the power feed lines 32 and 33. The operational amplifiers 26 and 27 are activated by the power supply voltage VDD. Preferably, each of the operational amplifiers 26 and 27 has a phase compensation circuit (not shown).

Each of the transistors Q22–Q37 includes a MOS transistor. The transistors Q31 and Q37 are of a same conductivity type. Specifically, the transistors Q31 and Q37 of the N-channel type. The drain of the transistor Q31 is connected to the base of the output transistor Q21. The source of the transistor Q31 is connected to the drain of the transistor Q37. The source of the transistor Q37 is connected to the power feed line (the ground line) 33. Accordingly, the transistors Q31 and Q37 are connected in series between the power feed line 33 and the base of the output transistor Q21.

In the differential amplifier circuit 28, the transistors Q22 and Q23 are of the N-channel type. The transistors Q22 and Q23 are connected to form a differential pair. The gate of the transistor Q22 is connected with a terminal 34 subjected to a reference voltage Vref1 corresponding to a command output voltage level V1. A voltage dividing circuit 35 is connected between the power-supply output terminal 23 and the negative power supply terminal 31 (the ground line 33). The voltage dividing circuit 35 is composed of resistors R27 and R28 connected in series between the power-supply output terminal 23 and the negative power supply terminal 31 (the ground line 33). The voltage dividing circuit 35 corresponds to a voltage detection circuit or a resistor-based voltage dividing circuit. The gate of the transistor Q23 is connected with the junction between the resistors R27 and R28.

In the differential amplifier circuit 28, the transistors Q28 and Q29 are of the N-channel type. The transistors Q28 and Q29 form an active load with respect to the differential pair of the transistors Q22 and Q23. The sources of the transistors Q28 and Q29 are connected with the ground line 33. The gates of the transistors Q28 and Q29 are connected to each other. The transistors Q24 and Q26 are of the P-channel type. The transistor Q24 is connected between the power feed line 32 and the transistor Q22. The transistor Q26 is connected between the power feed line 32 and the transistor Q28. The transistors Q25 and Q27 are of the P-channel type. The transistor Q25 is connected between the power feed line 32 and the transistor Q23. The transistor Q27 is connected between the power feed line 32 and the transistor Q29. The drain of the transistor Q27 is connected with the drain and gate of the transistor Q29. The transistors Q24 and Q26 are connected to form a current mirror circuit. The transistors Q25 and Q27 are connected to form a current mirror circuit.

In the differential amplifier circuit 28, the transistor Q30 is of the N-channel type. The drain of the transistor Q30, the source of the transistor Q22, and the source of the transistor Q23 are connected in common. The gate of the transistor Q30 is connected with a terminal 36 subjected to a bias voltage VBIAS1. The source of the transistor Q30 is connected with the ground line 33. The gate of the transistor Q31 in the operational amplifier 26 is connected to an output node of the differential amplifier circuit 28, that is, a junction between the drains of the transistors Q26 and Q28.

In the differential amplifier circuit 29, the transistors Q32 and Q33 are of the P-channel type. The transistors Q32 and Q33 are connected to form a differential pair. The gate of the transistor Q32 is connected with a terminal 37 subjected to a reference voltage Vref2 corresponding to a command limit current level I1. The gate of the transistor Q33 is connected with the output terminal of the amplifier circuit 24.

In the differential amplifier circuit 29, the transistors Q34 and Q35 are of the N-channel type. The transistors Q34 and Q35 form an active load with respect to the differential pair of the transistors Q32 and Q33. The transistor Q34 is connected between the transistor Q32 and the ground line (the power feed line) 33. The transistor Q35 is connected between the transistor Q33 and the ground line (the power feed line) 33. The gates of the transistors Q34 and Q35 are connected to each other. In addition, the gates of the transistors Q34 and Q35 are connected with the drains of the transistor Q32 and Q34.

In the differential amplifier circuit 29, the transistor Q36 is of the P-channel type. The source of the transistor Q36 is connected with the power feed line 32. The drain of the transistor Q36, the source of the transistor Q32, and the source of the transistor Q33 are connected in common. The gate of the transistor Q36 is connected with a terminal 38 subjected to a bias voltage VBIAS2. The gate of the transistor Q37 in the operational amplifier 27 is connected to an output node of the differential amplifier circuit 29, that is, a junction between the drains of the transistors Q33 and Q35.

The voltage regulator 21 operates as follows. The voltage regulator 21 starts operating in cases where a battery voltage Vb (for example, 12 V) is applied between the power-supply input terminal 22 and the ground terminal 31; the power supply voltage VDD (for example, 5 V) is applied between the positive and negative power supply terminals 30 and 31; the reference voltage Vref1 is applied between the terminals 34 and 31; the bias voltage VBIAS1 is applied between the terminals 36 and 31; the reference voltage Vref2 is applied between the terminals 37 and 31; and the bias voltage VBIAS2 is applied between the terminals 38 and 31.

The voltage regulator 21 generates an output voltage RVo which appears at the power-supply output terminal 23. A regulator load is connected between the power-supply output terminal 23 and the ground terminal 31. The regulator output voltage RVo is applied to the regulator load. The voltage regulator 21 generates an output current Io which flows into the regulator load via the power-supply output terminal 23.

Figure 8:
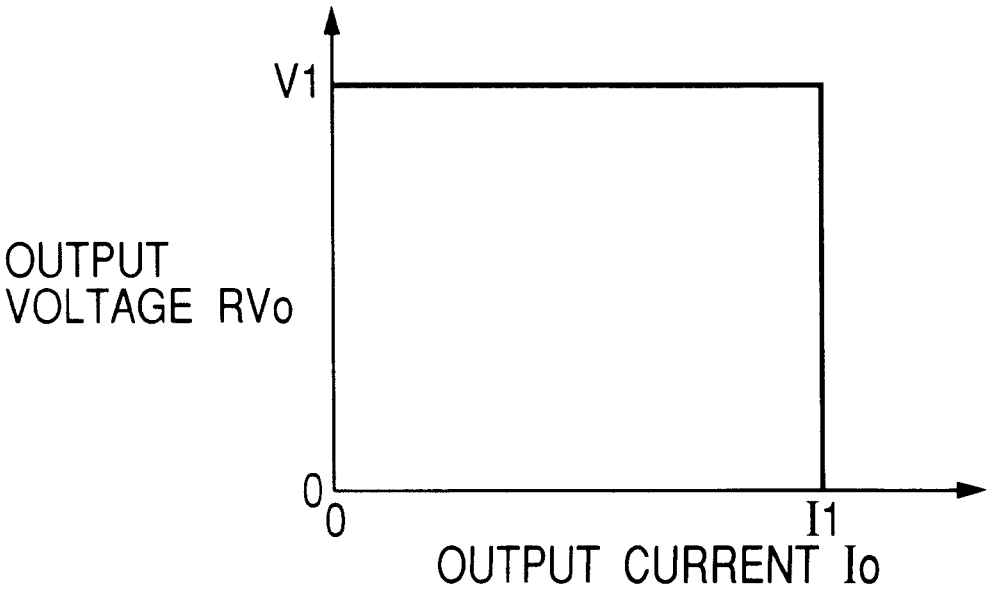
FIG. 8 is a diagram of the relation between a regulator output current and a regulator output voltage in the voltage regulator of FIG. 6.

As shown in FIG. 8, the regulator output voltage RVo has a specific relation with the regulator output current Io. In the case where the regulator output current Io is smaller than the command limit current level I1 corresponding to the reference voltage Vref2, the voltage regulator 21 implements constant-voltage control so that the regulator output voltage RVo will be equalized to the command output voltage level V1 (for example, 5 V) corresponding to the reference voltage Vref1. In the case where the resistance RL of the regulator load drops and hence the regulator output current Io attempts to exceed the command limit current level I1, that is, in the case where the voltage regulator 21 is overloaded, the voltage regulator 21 implements constant-current control so that the regulator output current Io will be equalized to the command limit current level I1.

Figure 9:
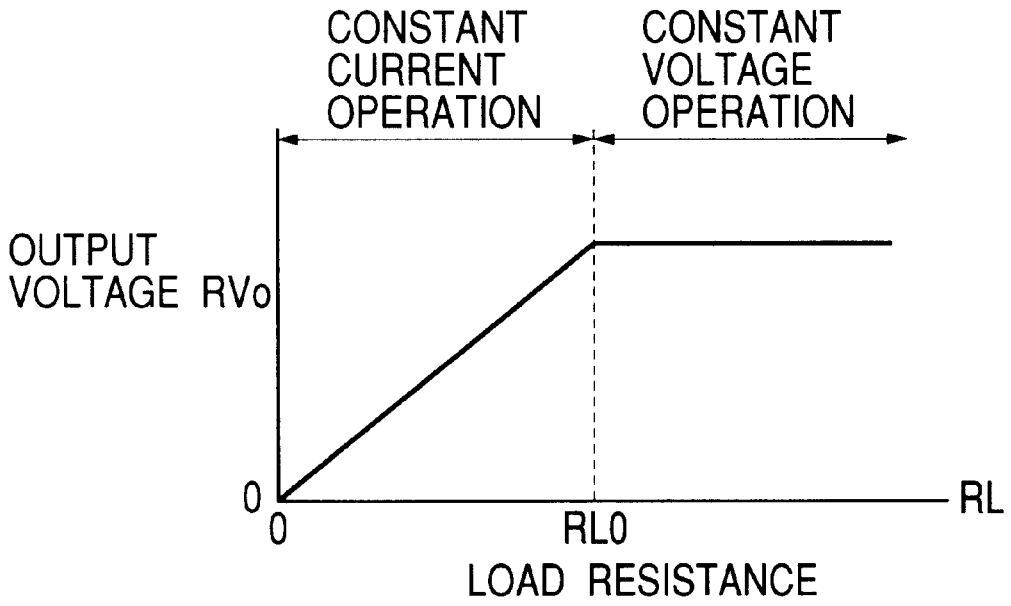
FIG. 9 is a diagram of the relation between a load resistance and a regulator output voltage in the voltage regulator of FIG. 6.
Figure 10:
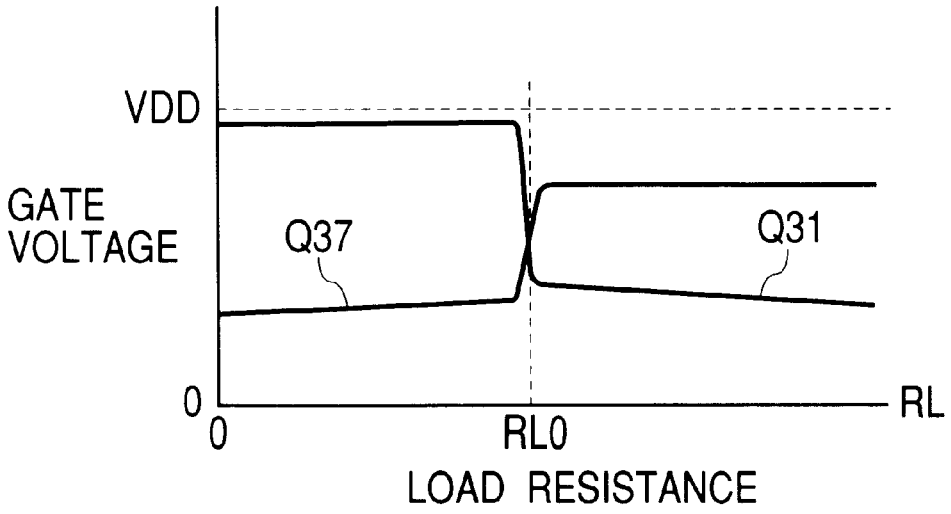
FIG. 10 is a diagram of the relation among a load resistance and voltages at the gates of transistors in the voltage regulator of FIG. 6.

As shown in FIG. 9, the regulator output voltage RVo varies in accordance with a change in the resistance RL of the regulator load. As shown in FIG. 10, the voltage at the gate of the transistor Q31 and the voltage at the gate of the transistor Q37 depend on the resistance RL of the regulator load. There is a specific value RL0 of the resistance RL of the regulator load. The specific value RL0 is equal to the command output voltage level V1 divided by the command limit current level I1.

In the case where the resistance RL of the regulator load is greater than the specific value RL0, operation of the voltage regulator 21 is in a normal mode. During the normal mode of operation, a voltage proportional to the regulator output current Io occurs across the resistor R21. The voltage across the resistor R21 is amplified into a detection voltage by the amplifier circuit 24. The detection voltage represents the regulator output current Io. The detection voltage is fed from the amplifier circuit 24 to the gate of the transistor Q33 in the differential amplifier circuit 29. The reference voltage Vref2 is applied to the gate of the transistor Q32 in the differential amplifier circuit 29. The differential amplifier circuit 29 outputs a voltage to the gate of the transistor Q37 which depends on the difference between the detection voltage and the reference voltage Vref2. The output voltage of the differential amplifier circuit 29 corresponds to a current limiting signal. During the normal mode of operation, since the regulator output current Io is smaller than the command limit current level I1 corresponding to the reference voltage Vref2, the detection voltage (the output voltage of the amplifier circuit 24) is lower than the reference voltage Vref2. Therefore, the output voltage of the differential amplifier circuit 29, that is, the voltage at the gate of the transistor Q37, is sufficiently higher than the threshold voltage related to the transistor Q37 (see FIG. 10). As a result, the transistor Q37 operates in a linear region (an active region), and the voltage between the drain and the source of the transistor Q37 is sufficiently low. In other words, the transistor Q37 is held in a sufficiently on state or a fully conductive state.

The regulator output voltage RVo is divided into a division-result voltage by the voltage dividing circuit 35. The division-result voltage is applied from the voltage dividing circuit 35 to the gate of the transistor Q23 in the differential amplifier circuit 28 as an indication of the regulator output voltage RVo. The reference voltage Vref1 is applied to the gate of the transistor Q22 in the differential amplifier circuit 28. The differential amplifier circuit 28 outputs a voltage to the gate of the transistor Q31 which depends on the difference between the division-result voltage and the reference voltage Vref1. The output voltage of the differential amplifier circuit 28 corresponds to a voltage error signal. During the normal mode of operation, the output voltage of the differential amplifier circuit 28, that is, the voltage at the gate of the transistor Q31, changes as the division-result voltage varies relative to the reference voltage Vref1. Thus, in this case, the transistor Q31 operates in a saturation region.

During the normal mode of operation, since the transistor Q37 is held in its sufficiently on state (its fully conductive state), the base current through the output transistor Q21 is controlled by only the transistor Q31. The resistor R21, the amplifier circuit 24, the differential amplifier circuit 29, and the transistors Q37 and Q21 compose a feedback loop for providing the constant-current control. During the normal mode of operation, since the transistor Q37 is held in its sufficiently on state, the constant-current control is disabled. The voltage dividing circuit 35, the differential amplifier circuit 28, and the transistors Q31 and Q21 compose a feedback loop for providing the constant-voltage control. During the normal mode of operation, since the base current through the output transistor Q21 is controlled by the transistor Q31, the constant-voltage control is active. In this way, during the normal mode of operation, the constant-voltage control is active while the constant-current control is inactive. The constant-voltage control equalizes the regulator output voltage RVo to the command output voltage level V1 which is given as follows.

$$RVo=V1=Vref1\cdot(R27+R28)/R28 \quad (1)$$

where "R27" and "R28" denote the resistances of the resistors R27 and R28 respectively.

In the case where the resistance RL of the regulator load is smaller than the specific value RL0, operation of the voltage regulator 21 is in an overcurrent protection mode. As previously mentioned, the division-result voltage generated by the voltage dividing circuit 35 is used an indication of the regulator output voltage RVo. During the overcurrent protection mode of operation, the division-result voltage generated by the voltage dividing circuit 35 is lower than the reference voltage Vref1 so that the voltage at the gate of the transistor Q31 (that is, the output voltage of the differential amplifier circuit 28) is sufficiently higher than the threshold voltage related to the transistor Q31 (see FIG. 10). As a result, the transistor Q31 operates in a linear region (an active region), and the voltage between the drain and the source of the transistor Q31 is sufficiently low. In other words, the transistor Q31 is held in a sufficiently on state or a fully conductive state.

As previously mentioned, the detection voltage outputted from the amplifier circuit 24 represents the regulator output current Io. The output voltage of the differential amplifier circuit 29, that is, the voltage at the gate of the transistor Q37, depends on the difference between the detection voltage and the reference voltage Vref2 corresponding to the command limit current level I1. During the overcurrent protection mode of operation, the voltage at the gate of the transistor Q37 changes as the detection voltage outputted from the amplifier circuit 24 varies relative to the reference voltage Vref2. Thus, in this case, the transistor Q37 operates in a saturation region.

During the overcurrent protection mode of operation, since the transistor Q31 is held in its sufficiently on state (its fully conductive state), the base current through the output transistor Q21 is controlled by only the transistor Q37. As previously mentioned, the resistor R21, the amplifier circuit 24, the differential amplifier circuit 29, and the transistors Q37 and Q21 compose the feedback loop for providing the constant-current control. During the overcurrent protection mode of operation, since the base current through the output transistor Q21 is controlled by the transistor Q37, the constant-current control is active. As previously mentioned, the voltage dividing circuit 35, the differential amplifier circuit 28, and the transistors Q31 and Q21 compose the feedback loop for providing the constant-voltage control. During the overcurrent protection mode of operation, since the transistor Q31 is held in its sufficiently on state, the constant-voltage control is disabled. In this way, during the overcurrent protection mode of operation, the constant-current control is active while the constant-voltage control is inactive. The constant-current control equalizes the regulator output current Io to the command limit current level I1 which is given as follows.

$$Io=I1=Vref2/(Av\cdot R21) \quad (2)$$

where "Av" denotes the voltage gain of the amplifier circuit 24, and "R21" denotes the resistance of the resistor R21.

The transistor Q31 is used in the constant-voltage control while the transistor Q37 is used in the constant-current control. The transistors Q31 and Q37 are connected in series. The series connection of the transistors Q31 and Q37 is interposed in the line leading from the base of the output transistor Q21. The transistors Q31 and Q37 control the base current through the output transistor Q21 while the constant-voltage control and the constant-current control are prevented from adversely interfering with each other. Therefore, a wasteful current hardly flows regarding the control of the base current through the output transistor Q21. Accordingly, the voltage regulator 21 is high in power efficiency.

The control of the transistor Q31 in response to the voltage error signal from the differential amplifier circuit 28 and the control of the transistor Q37 in response to the current limiting signal from the differential amplifier circuit 29 are independent of each other. Thus, it is unnecessary to provide a circuit for combining the voltage error signal and the current limiting signal which would cause a considerable signal phase delay. Accordingly, the operation of the voltage regulator 21 is relatively stable.

The output transistor Q21 is separate from the operational amplifiers 26 and 27. This design is advantageous in cooling the output transistor Q21. In addition, it is possible to freely set the size of the output transistor Q21 independent of the operational amplifiers 26 and 27. Therefore, a high degree of freedom is available in setting the regulator output current Io.

Second Embodiment

Figure 11:
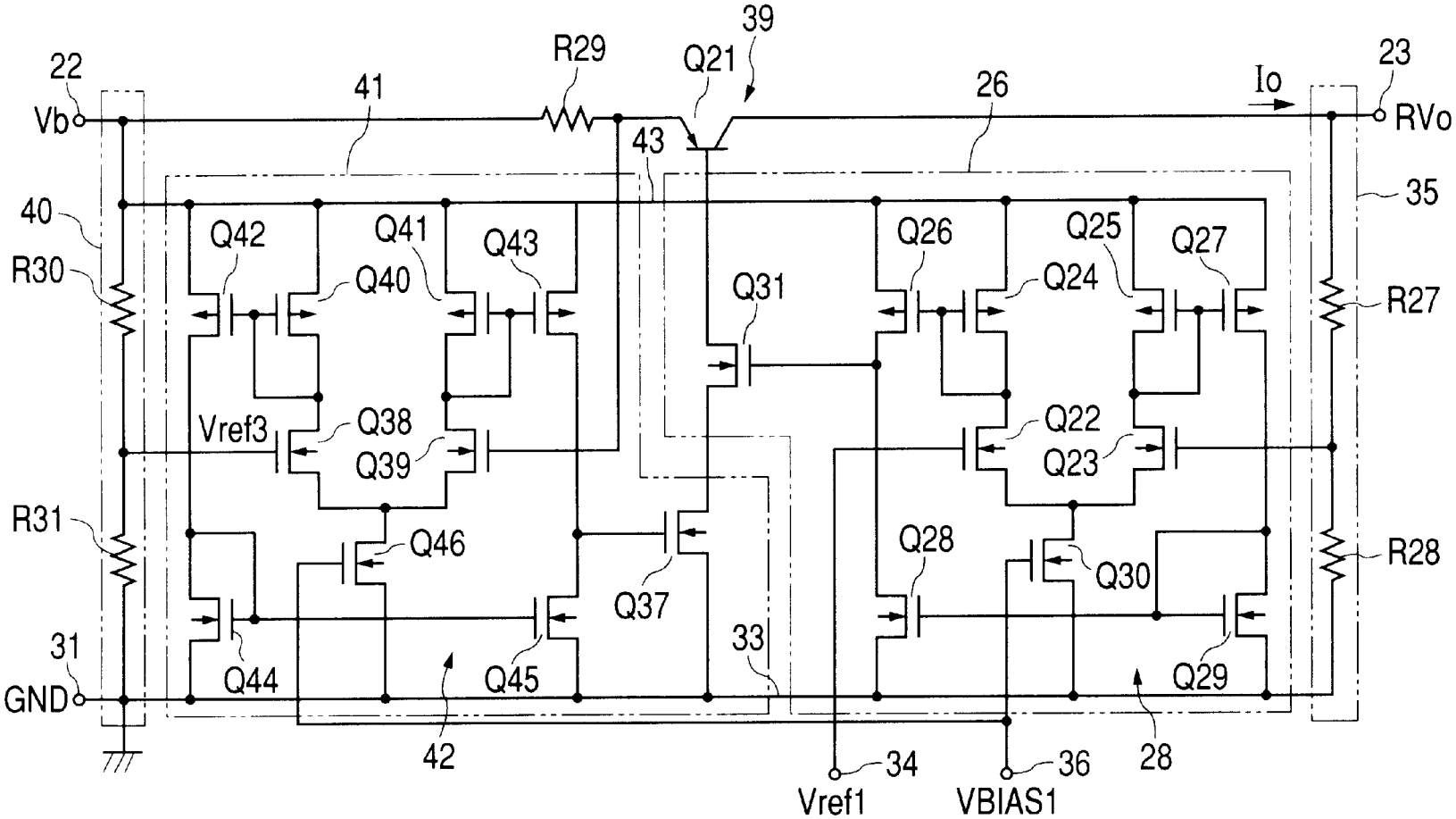
FIG. 11 is a schematic diagram of a voltage regulator according to a second embodiment of this invention.

FIG. 11 shows a voltage regulator 39 according to a second embodiment of this invention. The voltage regulator 39 is similar to the voltage regulator 21 in FIG. 6 except for design changes mentioned hereafter. The resistor R21 and the amplifier circuit 24 (see FIG. 6) are omitted from the voltage regulator 39.

With reference to FIG. 11, in the voltage regulator 39, the collector of the output transistor Q21 is directly connected to the power-supply output terminal 23. A resistor R29 which corresponds to a current sensing resistor is connected between the power-supply input terminal 22 and the emitter of the output transistor Q21. A voltage dividing circuit 40 is connected between the power-supply input terminal 22 and the negative power supply terminal 31 (the ground line 33). The voltage dividing circuit 40 is composed of resistors R30 and R31 connected in series between the power-supply input terminal 22 and the negative power supply terminal 31 (the ground line 33). The voltage dividing circuit 40 corresponds to a resistor-based voltage dividing circuit. The battery voltage Vb is applied between the power-supply input terminal 22 and the negative power supply terminal 31. The voltage dividing circuit 40 divides the battery voltage Vb, thereby generating a reference voltage Vref3 which appears at the junction between the resistors R30 and R31. The reference voltage Vref3 corresponds to a command limit current level I1.

The voltage regulator 39 includes an operational amplifier 41 instead of the operational amplifier 27 (see FIG. 6). The operational amplifier 41 is designed to implement constant-current control when the voltage regulator 39 is overloaded. The operational amplifier 41 is composed of a differential amplifier circuit 42 and the transistor Q37. The differential amplifier circuit 42 corresponds to a second amplifier circuit. The differential amplifier circuit 42 has a combination of MOS transistors Q38–Q46. The transistor Q37 is controlled by the differential amplifier circuit 42. The transistors Q38–Q46 in the differential amplifier circuit 42 correspond to the transistors Q22–Q30 in the differential amplifier circuit 28. The structures of the differential amplifier circuits 28 and 42 are the same. Preferably, each of the operational amplifiers 26 and 41 has a phase compensation circuit (not shown).

In the differential amplifier circuit 42, the transistors Q38 and Q39 are connected to form a differential pair. The gate of the transistor Q38 is connected with the junction between the resistors R30 and R31 in the voltage dividing circuit 40. Thus, the gate of the transistor Q38 is subjected to the reference voltage Vref3. The gate of the transistor Q39 is connected with the junction between the resistor R29 and the emitter of the output transistor Q21. The gate of the transistor Q46 is connected with the terminal 36 which is subjected to the bias voltage VBIAS1.

The operational amplifiers 26 and 41 are connected to the power-supply input terminal 22 via a power feed line 43 which replaces the power feed line 32 (see FIG. 6). The operational amplifiers 26 and 41 are activated by the battery voltage Vb.

Operation of the voltage regulator 39 is basically similar to that of the voltage regulator 21 (see FIG. 6). A regulator output current Io flows into a regulator load via the resistor R29, the output transistor Q21, and the power-supply output terminal 23. A voltage at the junction between the resistor R29 and the emitter of the output transistor Q21 depends on the regulator output current Io. The voltage at the junction between the resistor R29 and the emitter of the output transistor Q21 is applied to the gate of the transistor Q39 as a detection voltage indicative of the regulator output current Io. On the other hand, the gate of the transistor Q38 is subjected to the reference voltage Vref3 which results from dividing the battery voltage Vb, and which corresponds the command limit current level I1. The differential amplifier circuit 42 outputs a voltage to the gate of the transistor Q37 which depends on the difference between the detection voltage and the reference voltage Vref3, that is, the difference between the regulator output current Io and the command limit current level I1.

As previously mentioned, the amplifier circuit 24 (see FIG. 6) is omitted from the voltage regulator 39. Thus, a signal phase delay caused by the amplifier circuit 24 is absent from the voltage regulator 39, and an enhanced stability of the constant-current control is available.

The command limit current level I1 corresponding to the reference voltage Vref3 is given as follows.

$$I1=Vb/R29\cdot\{R30/(R30+R31)\} \quad (3)$$

where "R29", "R30", and "R31" denote the resistances of the resistors R29, R30, and R31 respectively. The factor of the proportionality between the command limit current level I1 and the battery voltage Vb corresponds to the value "R30/(R30+R31)" less than 1.0. This proportionality factor is advantageous in maintaining the stability of the command limit current level I1 with respect to a fluctuation in the battery voltage Vb.

Third Embodiment

Figure 12:
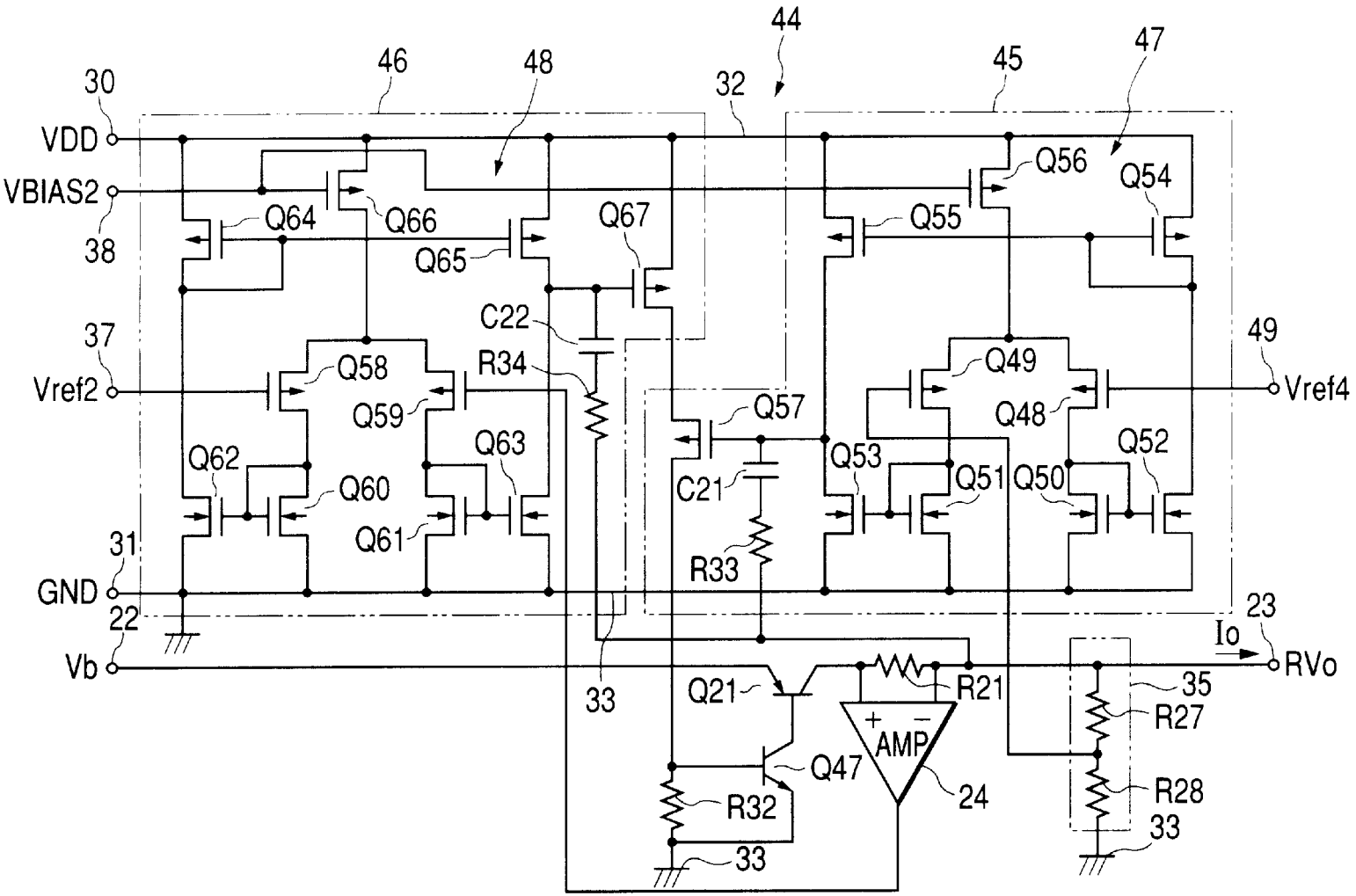
FIG. 12 is a schematic diagram of a voltage regulator according to a third embodiment of this invention.

FIG. 12 shows a voltage regulator 44 according to a third embodiment of this invention. The voltage regulator 44 is similar to the voltage regulator 21 in FIG. 6 except for design changes mentioned hereafter.

As shown in FIG. 12, the voltage regulator 44 includes an NPN transistor Q47 for driving the output transistor Q21. The transistor Q47 corresponds to a drive transistor. The collector of the transistor Q47 is connected with the base of the output transistor Q21. The emitter of the transistor Q47 is connected with the power feed line (the ground line) 33. A resistor R32 is connected between the base of the transistor Q47 and the emitter thereof. Preferably, the output transistor Q21, the transistor Q47, and the resistors R21 and R32 are located outside an IC package.

The voltage regulator 44 includes operational amplifiers 45 and 46 instead of the operational amplifiers 26 and 27 respectively. The operational amplifiers 45 and 46 are used in controlling the output transistor Q21 via the drive transistor Q47. The operational amplifier 45 is designed to implement constant-voltage control. The operational amplifier 46 is designed to implement constant-current control.

The operational amplifier 45 is composed of a differential amplifier circuit 47 and a transistor Q57. The differential amplifier circuit 47 corresponds to a first amplifier circuit. The differential amplifier circuit 47 has a combination of transistors Q48–Q56. The transistor Q57 corresponds to a first transistor. The transistor Q57 is controlled by the differential amplifier circuit 47. The operational amplifier 46 is composed of a differential amplifier circuit 48 and a transistor Q67. The differential amplifier circuit 48 corresponds to a second amplifier circuit. The differential amplifier circuit 48 has a combination of transistors Q58–Q66. The transistor Q67 corresponds to a second transistor. The transistor Q67 is controlled by the differential amplifier circuit 48. The operational amplifiers 45 and 46 are connected via the power feed line 32 to the positive power supply terminal 30. The operational amplifiers 45 and 46 are connected via the power feed line 33 to the negative power supply terminal (the ground terminal) 31. The power supply voltage VDD is applied between the positive and negative power supply terminals 30 and 31. The negative power supply terminal 31 is subjected to the ground potential. The power supply voltage VDD is fed to the operational amplifiers 45 and 46 via the positive and negative power supply terminals 30 and 31 and the power feed lines 32 and 33. The operational amplifiers 45 and 46 are activated by the power supply voltage VDD.

Each of the transistors Q48–Q66 includes a MOS transistor. The transistors Q57 and Q67 are of a same conductivity type. Specifically, the transistors Q57 and Q67 of the P-channel type. The drain of the transistor Q57 is connected to the base of the transistor Q47. The source of the transistor Q57 is connected to the drain of the transistor Q67. The source of the transistor Q67 is connected to the power feed line 32. Accordingly, the transistors Q57 and Q67 are connected in series between the power feed line 32 and the base of the transistor Q47.

The combination of the transistors Q48–Q56 in the differential amplifier circuit 47 corresponds to the combination of the transistors Q22–Q30 in the differential amplifier circuit 28 (see FIG. 6). The conductivity types of the transistors Q48–Q56 are opposite to those of the transistors Q22–Q30. The connection of the combination of the transistors Q48–Q56 with the power feed lines 32 and 33 is reverse with respect to that of the combination of the transistors Q22–Q30.

The structure of the differential amplifier circuit 48 is the same as that of the differential amplifier circuit 47. Specifically, the structure of the combination of the transistors Q58–Q66 in the differential amplifier circuit 48 is the same as that of the combination of the transistors Q48–Q56 in the differential amplifier circuit 47.

In the differential amplifier circuit 47, the transistors Q48 and Q49 are connected to form a differential pair. The gate of the transistor Q48 is connected with a terminal 49 subjected to a reference voltage Vref4 corresponding to a command output voltage level V1. The gate of the transistor Q49 is connected with the junction between the resistors R27 and R28 in the voltage dividing circuit 35.

In the differential amplifier circuit 47, the transistors Q54 and Q55 form an active load with respect to the differential pair of the transistors Q48 and Q49. The sources of the transistors Q54 and Q55 are connected with the power feed line 32. The gates of the transistors Q54 and Q55 are connected to each other. The transistor Q50 is connected between the ground line 33 and the transistor Q48. The transistor Q52 is connected between the ground line 33 and the transistor Q54. The drain of the transistor Q52 is connected with the drain and gate of the transistor Q54. The transistor Q51 is connected between the ground line 33 and the transistor Q49. The transistor Q53 is connected between the ground line 33 and the transistor Q55. The transistors Q50 and Q52 are connected to form a current mirror circuit. The transistors Q51 and Q53 are connected to form a current mirror circuit.

In the differential amplifier circuit 47, the drain of the transistor Q56, the source of the transistor Q48, and the source of the transistor Q49 are connected in common. The gate of the transistor Q56 is connected with the terminal 38 subjected to the bias voltage VBIAS2. The source of the transistor Q56 is connected with the power feed line 32. The gate of the transistor Q57 in the operational amplifier 45 is connected to an output node of the differential amplifier circuit 47, that is, a junction between the drains of the transistors Q53 and Q55. The operational amplifier 45 includes a series combination of a capacitor C21 and a resistor R33 which forms a phase compensation circuit. The series combination of the capacitor C21 and the resistor R33 is connected between the power-supply output terminal 23 and the gate of the transistor Q57.

In the differential amplifier circuit 48, the transistors Q58 and Q59 are connected to form a differential pair. The gate of the transistor Q58 is connected with the terminal 37 subjected to the reference voltage Vref2 corresponding to the command limit current level I1. The gate of the transistor Q59 is connected with the output terminal of the amplifier circuit 24.

In the differential amplifier circuit 48, the transistors Q64 and Q65 form an active load with respect to the differential pair of the transistors Q58 and Q59. The sources of the transistors Q64 and Q65 are connected with the power feed line 32. The gates of the transistors Q64 and Q65 are connected to each other. The transistor Q60 is connected between the ground line 33 and the transistor Q58. The transistor Q62 is connected between the ground line 33 and the transistor Q64. The drain of the transistor Q62 is connected with the drain and gate of the transistor Q64. The transistor Q61 is connected between the ground line 33 and the transistor Q59. The transistor Q63 is connected between the ground line 33 and the transistor Q65. The transistors Q60 and Q62 are connected to form a current mirror circuit. The transistors Q61 and Q63 are connected to form a current mirror circuit.

In the differential amplifier circuit 48, the drain of the transistor Q66, the source of the transistor Q58, and the source of the transistor Q59 are connected in common. The gate of the transistor Q66 is connected with the terminal 38 subjected to the bias voltage VBIAS2. The source of the transistor Q66 is connected with the power feed line 32. The gate of the transistor Q67 in the operational amplifier 46 is connected to an output node of the differential amplifier circuit 48, that is, a junction between the drains of the transistors Q63 and Q65. The operational amplifier 46 includes a series combination of a capacitor C22 and a resistor R34 which forms a phase compensation circuit. The series combination of the capacitor C22 and the resistor R34 is connected between the power-supply output terminal 23 and the gate of the transistor Q67.

Operation of the voltage regulator 44 is basically similar to that of the voltage regulator 21 (see FIG. 6). A current from the power feed line 32 flows through the transistors Q67 and Q57 before entering the transistor Q47 as a base current. The base current through the output transistor Q21 enters the transistor Q47 as a collector current. The transistor Q47 amplifies its base current. The amplification of the base current is reflected in the collector current through the transistor Q47, that is, the base current through the output transistor Q21. Therefore, a smaller current flowing through the transistors Q67 and Q57 suffices. Therefore, the regulator output current Io can be set to a great value even when the sizes of the transistors Q57 and Q67 are small.

The voltage at the drain of the transistor Q57 remains equal to the voltage (about 0.7 V) between the base and the emitter of the transistor Q47 independent of the voltage applied to the power-supply input terminal 22. Accordingly, it is sufficient for the transistors Q57 and Q67 to withstand a low voltage. Thus, the transistors Q57 and Q67 can be made by general CMOSLSI fabrication technologies advantageous in manufacture cost.

Fourth Embodiment

Figure 13:
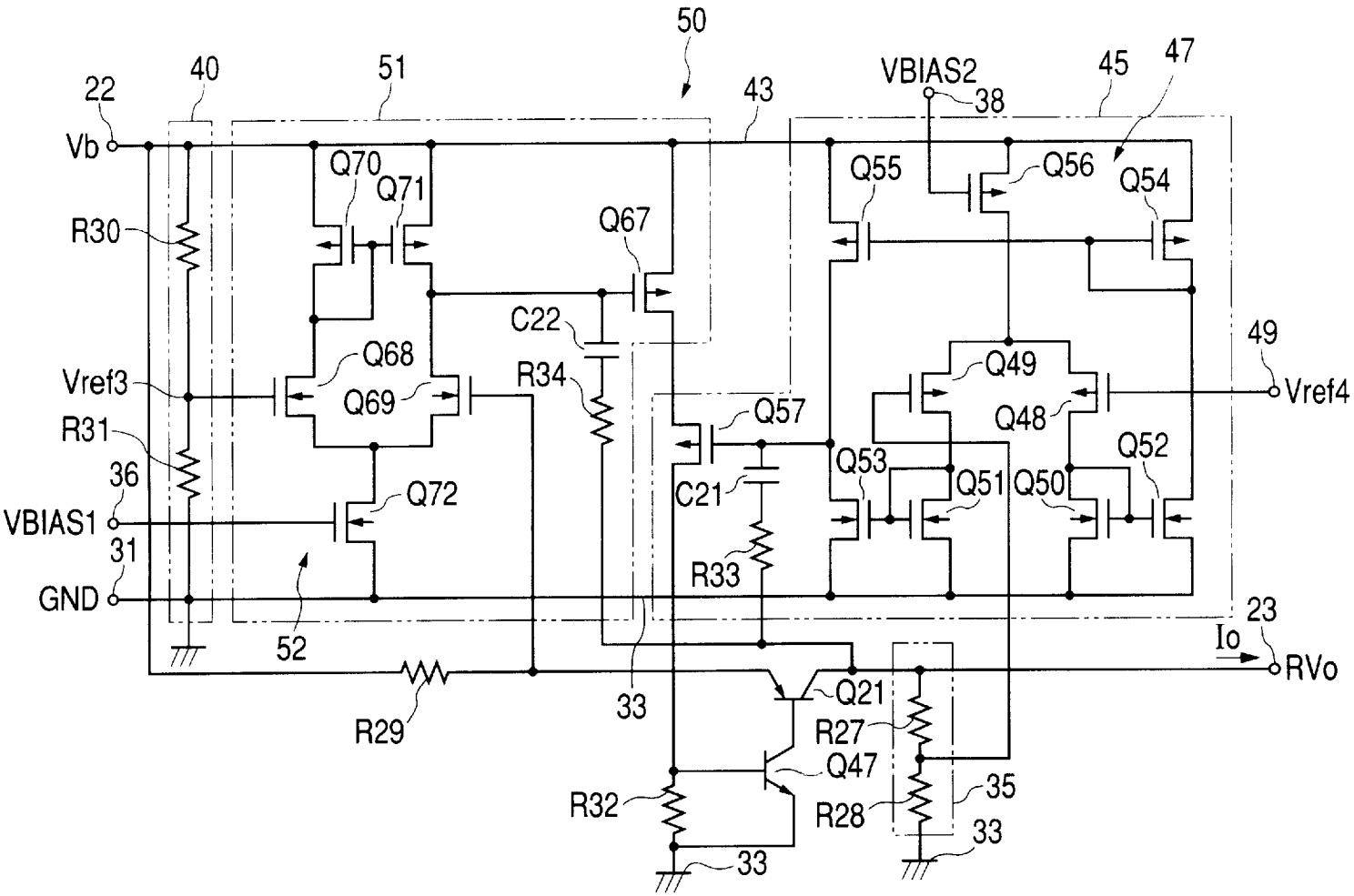
FIG. 13 is a schematic diagram of a voltage regulator according to a fourth embodiment of this invention.

FIG. 13 shows a voltage regulator 50 according to a fourth embodiment of this invention. The voltage regulator 50 is similar to the voltage regulator 44 in FIG. 12 except for design changes mentioned hereafter. The resistor R21 and the amplifier circuit 24 (see FIG. 12) are omitted from the voltage regulator 50.

With reference to FIG. 13, in the voltage regulator 50, the collector of the output transistor Q21 is directly connected to the power-supply output terminal 23. A resistor R29 which corresponds to a current sensing resistor is connected between the power-supply input terminal 22 and the emitter of the output transistor Q21. A voltage dividing circuit 40 is connected between the power-supply input terminal 22 and the negative power supply terminal 31 (the ground line 33). The voltage dividing circuit 40 is composed of resistors R30 and R31 connected in series between the power-supply input terminal 22 and the negative power supply terminal 31 (the ground line 33). The voltage dividing circuit 40 corresponds to a resistor-based voltage dividing circuit. The battery voltage Vb is applied between the power-supply input terminal 22 and the negative power supply terminal 31. The voltage dividing circuit 40 divides the battery voltage Vb, thereby generating a reference voltage Vref3 which appears at the junction between the resistors R30 and R31. The reference voltage Vref3 corresponds to a command limit current level I1.

The voltage regulator 50 includes an operational amplifier 51 instead of the operational amplifier 46 (see FIG. 12). The operational amplifier 51 is designed to implement constant-current control when the voltage regulator 50 is overloaded. The operational amplifier 51 includes a differential amplifier circuit 52 and the transistor Q67. The differential amplifier circuit 52 corresponds to a second amplifier circuit. The differential amplifier circuit 52 has a combination of MOS transistors Q68–Q72. The transistor Q67 is controlled by the differential amplifier circuit 52.

The combination of the transistors Q68–Q72 in the differential amplifier circuit 52 corresponds to the combination of the transistors Q32–Q36 in the differential amplifier circuit 29 (see FIG. 6). The conductivity types of the transistors Q68–Q72 are opposite to those of the transistors Q32–Q36. The connection of the combination of the transistors Q68–Q72 with the power feed lines 32 and 33 is reverse with respect to that of the combination of the transistors Q32–Q36.

The operational amplifiers 45 and 51 are connected to the power-supply input terminal 22 via a power feed line 43 which replaces the power feed line 32 (see FIG. 12). The operational amplifiers 45 and 51 are activated by the battery voltage Vb.

In the differential amplifier circuit 52, the transistors Q68 and Q69 are connected to form a differential pair. The gate of the transistor Q68 is connected with the junction between the resistors R30 and R31 in the voltage dividing circuit 40. Thus, the gate of the transistor Q68 is subjected to the reference voltage Vref3. The gate of the transistor Q69 is connected with the junction between the resistor R29 and the emitter of the output transistor Q21.

In the differential amplifier circuit 52, the transistors Q70 and Q71 form an active load with respect to the differential pair of the transistors Q68 and Q69. The transistor Q70 is connected between the transistor Q68 and the power feed line 43. The transistor Q71 is connected between the transistor Q69 and the power feed line 43. The gates of the transistors Q70 and Q71 are connected to each other. In addition, the gates of the transistors Q70 and Q71 are connected with the drains of the transistors Q68 and Q70.

In the differential amplifier circuit 52, the source of the transistor Q72 is connected with the ground line 33. The drain of the transistor Q72, the source of the transistor Q68, and the source of the transistor Q69 are connected in common. The gate of the transistor Q72 is connected with the terminal 36 subjected to the bias voltage VBIAS1. The gate of the transistor Q67 in the operational amplifier 51 is connected to an output node of the differential amplifier circuit 52, that is, a junction between the drains of the transistors Q69 and Q71. The operational amplifier 51 includes the series combination of the capacitor C22 and the resistor R34 which forms the phase compensation circuit. The series combination of the capacitor C22 and the resistor R34 is connected between the power-supply output terminal 23 and the gate of the transistor Q67.

Operation of the voltage regulator 50 is basically similar to that of the voltage regulator 44 (see FIG. 12). A regulator output current Io flows into a regulator load via the resistor R29, the output transistor Q21, and the power-supply output terminal 23. A voltage at the junction between the resistor R29 and the emitter of the output transistor Q21 depends on the regulator output current Io. The voltage at the junction between the resistor R29 and the emitter of the output transistor Q21 is applied to the gate of the transistor Q69 as a detection voltage indicative of the regulator output current Io. On the other hand, the gate of the transistor Q68 is subjected to the reference voltage Vref3 which results from dividing the battery voltage Vb, and which corresponds the command limit current level I1. The differential amplifier circuit 52 outputs a voltage to the gate of the transistor Q67 which depends on the difference between the detection voltage and the reference voltage Vref3, that is, the difference between the regulator output current Io and the command limit current level I1.

As previously mentioned, the amplifier circuit 24 (see FIG. 12) is omitted from the voltage regulator 50. Thus, a signal phase delay caused by the amplifier circuit 24 is absent from the voltage regulator 50, and an enhanced stability of the constant-current control is available. The command limit current level I1 corresponding to the reference voltage Vref3 is given according to the previously-indicated equation (3). The factor of the proportionality between the command limit current level I1 and the battery voltage Vb corresponds to the value "R30/(R30+R31)" less than 1.0. This proportionality factor is advantageous in maintaining the stability of the command limit current level I1 with respect to a fluctuation in the battery voltage Vb.

Fifth Embodiment

Figure 14:
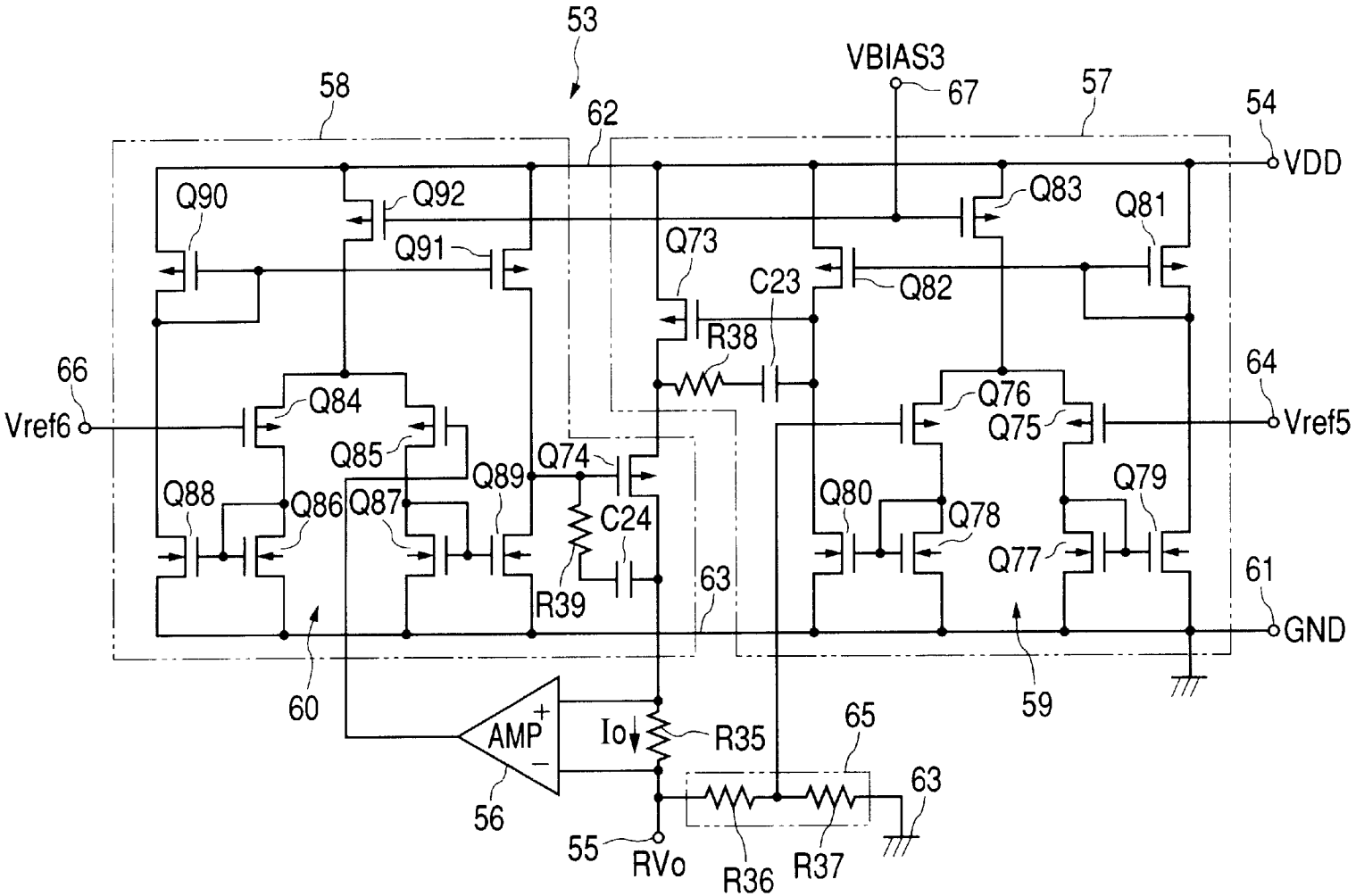
FIG. 14 is a schematic diagram of a voltage regulator according to a fifth embodiment of this invention.

FIG. 14 shows a voltage regulator 53 according to a fifth embodiment of this invention. The voltage regulator 53 has an overcurrent protection function of the constant-current type. For example, the voltage regulator 53 is designed as a power supply IC in an electronic control unit for controlling an engine.

As shown in FIG. 14, the voltage regulator 53 includes a power-supply input terminal 54, a power-supply output terminal 55, a resistor R35, and MOS transistors Q73 and Q74. The transistors Q73 and Q74 are of a same conductivity type. Specifically, the transistors Q73 and Q74 are of the P-channel type. The source of the transistor Q73 is connected with the power-supply input terminal 54. The drain of the transistor Q73 is connected with the source of the transistor Q74. The drain of the transistor Q74 is connected via the resistor R35 with the power-supply output terminal 55. Thus, the transistors Q73 and Q74 and the resistor R35 are connected in series between the power-supply input terminal 54 and the power-supply output terminal 55. The resistor R35 corresponds to a current sensing resistor. The voltage which appears across the resistor R35 is applied to an amplifier circuit 56. The resistor R35 and the amplifier circuit 56 compose a current detection circuit.

The voltage regulator 53 includes operational amplifiers 57 and 58. The operational amplifier 57 is designed for constant-voltage control. The operational amplifier 58 is designed for constant-current control. The operational amplifier 57 is composed of a differential amplifier circuit 59 and the transistor Q73. The differential amplifier circuit 59 corresponds to a first amplifier circuit. The differential amplifier circuit 59 has a combination of transistors Q75–Q83. The transistor Q73 corresponds to a first transistor. The transistor Q73 is controlled by the differential amplifier circuit 59. The operational amplifier 58 is composed of a differential amplifier circuit 60 and the transistor Q74. The differential amplifier circuit 60 corresponds to a second amplifier circuit. The differential amplifier circuit 60 has a combination of transistors Q84–Q92. The transistor Q74 corresponds to a second transistor. The transistor Q74 is controlled by the differential amplifier circuit 60. The operational amplifiers 57 and 58 are connected via a power feed line 62 to the power-supply input terminal 54. The operational amplifiers 57 and 58 are connected via a power feed line 63 to a power supply terminal 61. A power supply voltage VDD is applied between the power-supply input terminal 54 and the power supply terminal 61. The power supply terminal 61 is subjected to a ground potential. Thus, the power supply terminal 61 is also referred to as the ground terminal 61, and the power feed line 63 is also referred to as the ground line 63. The power supply voltage VDD is fed to the operational amplifiers 57 and 58 via the power-supply input terminal 54, the ground terminal 61, and the power feed lines 62 and 63. The operational amplifiers 57 and 58 are activated by the power supply voltage VDD. Each of the transistors Q75–Q92 includes a MOS transistor.

In the differential amplifier circuit 59, the transistors Q75 and Q76 are of the P-channel type. The transistors Q75 and Q76 are connected to form a differential pair. The gate of the transistor Q75 is connected with a terminal 64 subjected to a reference voltage Vref5 corresponding to a command output voltage level V1. A voltage dividing circuit 65 is connected between the power-supply output terminal 55 and the ground line 63 (the ground terminal 61). The voltage dividing circuit 65 is composed of resistors R36 and R37 connected in series between the power-supply output terminal 55 and the ground line 63 (the ground terminal 61). The voltage dividing circuit 65 corresponds to a voltage detection circuit or a resistor-based voltage dividing circuit. The gate of the transistor Q76 is connected with the junction between the resistors R36 and R37.

In the differential amplifier circuit 59, the transistors Q81 and Q82 are of the P-channel type. The transistors Q81 and Q82 form an active load with respect to the differential pair of the transistors Q75 and Q76. The sources of the transistors Q81 and Q82 are connected with the power feed line 62. The gates of the transistors Q81 and Q82 are connected to each other. The transistors Q77 and Q79 are of the N-channel type. The transistor Q77 is connected between the ground line 63 and the transistor Q75. The transistor Q79 is connected between the ground line 63 and the transistor Q81. The drain of the transistor Q79 is connected with the drain and gate of the transistor Q81. The transistors Q78 and Q80 are of the N-channel type. The transistor Q78 is connected between the ground line 63 and the transistor Q76. The transistor Q80 is connected between the ground line 63 and the transistor Q82. The transistors Q77 and Q79 are connected to form a current mirror circuit. The transistors Q78 and Q80 are connected to form a current mirror circuit.

In the differential amplifier circuit 59, the transistor Q83 is of the P-channel type. The drain of the transistor Q83, the source of the transistor Q75, and the source of the transistor Q76 are connected in common. The gate of the transistor Q83 is connected with a terminal 67 subjected to a bias voltage VBIAS3. The source of the transistor Q83 is connected with the power feed line 62. The gate of the transistor Q73 in the operational amplifier 57 is connected to an output node of the differential amplifier circuit 59, that is, a junction between the drains of the transistors Q80 and Q82. The operational amplifier 57 includes a series combination of a capacitor C23 and a resistor R38 which forms a phase compensation circuit. The series combination of the capacitor C23 and the resistor R38 is connected between the gate and the drain of the transistor Q73.

In the differential amplifier circuit 60, the transistors Q84 and Q85 are of the P-channel type. The transistors Q84 and Q85 are connected to form a differential pair. The gate of the transistor Q84 is connected with a terminal 66 subjected to a reference voltage Vref6 corresponding to a command limit current level I1. The gate of the transistor Q85 is connected with the output terminal of the amplifier circuit 56.

In the differential amplifier circuit 60, the transistors Q90 and Q91 are of the P-channel type. The transistors Q90 and Q91 form an active load with respect to the differential pair of the transistors Q84 and Q85. The sources of the transistors Q90 and Q91 are connected with the power feed line 62. The gates of the transistors Q90 and Q91 are connected to each other. The transistors Q86 and Q88 are of the N-channel type. The transistor Q86 is connected between the ground line 63 and the transistor Q84. The transistor Q88 is connected between the ground line 63 and the transistor Q90. The drain of the transistor Q88 is connected with the drain and gate of the transistor Q90. The transistors Q87 and Q89 are of the N-channel type. The transistor Q87 is connected between the ground line 63 and the transistor Q85. The transistor Q89 is connected between the ground line 63 and the transistor Q91. The transistors Q86 and Q88 are connected to form a current mirror circuit. The transistors Q87 and Q89 are connected to form a current mirror circuit.

In the differential amplifier circuit 60, the transistor Q92 is of the P-channel type. The drain of the transistor Q92, the source of the transistor Q84, and the source of the transistor Q85 are connected in common. The gate of the transistor Q92 is connected with the terminal 67 subjected to the bias voltage VBIAS3. The source of the transistor Q92 is connected with the power feed line 62. The gate of the transistor Q74 in the operational amplifier 58 is connected to an output node of the differential amplifier circuit 60, that is, a junction between the drains of the transistors Q89 and Q91. The operational amplifier 58 includes a series combination of a capacitor C24 and a resistor R39 which forms a phase compensation circuit. The series combination of the capacitor C24 and the resistor R39 is connected between the gate and the drain of the transistor Q74.

The voltage regulator 53 operates as follows. The voltage regulator 53 starts operating in cases where the power supply voltage VDD is applied between the power-supply input terminal 54 and the ground terminal 61; the reference voltage Vref5 is applied between the terminals 64 and 61; the reference voltage Vref6 is applied between the terminals 66 and 61; and the bias voltage VBIAS3 is applied between the terminals 67 and 61.

The voltage regulator 53 generates an output voltage RVo which appears at the power-supply output terminal 55. A regulator load is connected between the power-supply output terminal 55 and the ground terminal 61. The regulator output voltage RVo is applied to the regulator load. The voltage regulator 53 generates an output current Io which flows into the regulator load via the power-supply output terminal 55. The transistors Q73 and Q74 act as output transistors. The regulator output current Io flows through the transistors Q73 and Q74 and the resistor R35 before entering the regulator load.

The regulator output voltage RVo varies in accordance with a change in the resistance RL of the regulator load. There is a specific value RL0 of the resistance RL of the regulator load. The specific value RL0 is equal to the command output voltage level V1 divided by the command limit current level I1.

In the case where the resistance RL of the regulator load is greater than the specific value RL0, operation of the voltage regulator 53 is in a normal mode. During the normal mode of operation, a voltage proportional to the regulator output current Io occurs across the resistor R35. The voltage across the resistor R35 is amplified into a detection voltage by the amplifier circuit 56. The detection voltage represents the regulator output current Io. The detection voltage is fed from the amplifier circuit 56 to the gate of the transistor Q85 in the differential amplifier circuit 60. The reference voltage Vref6 is applied to the gate of the transistor Q84 in the differential amplifier circuit 60. The differential amplifier circuit 60 outputs a voltage to the gate of the transistor Q74 which depends on the difference between the detection voltage and the reference voltage Vref6. The output voltage of the differential amplifier circuit 60 corresponds to a current limiting signal. During the normal mode of operation, since the regulator output current Io is smaller than the command limit current level I1 corresponding to the reference voltage Vref6, the detection voltage (the output voltage of the amplifier circuit 56) is lower than the reference voltage Vref6. Therefore, the output voltage of the differential amplifier circuit 60, that is, the voltage at the gate of the transistor Q74, sufficiently overcomes the threshold voltage related to the transistor Q74. As a result, the transistor Q74 operates in a linear region (an active region), and the voltage between the drain and the source of the transistor Q74 is sufficiently low. In other words, the transistor Q74 is held in a sufficiently on state or a fully conductive state.

The regulator output voltage RVo is divided into a division-result voltage by the voltage dividing circuit 65. The division-result voltage is applied from the voltage dividing circuit 65 to the gate of the transistor Q75 in the differential amplifier circuit 59 as an indication of the regulator output voltage RVo. The reference voltage Vref5 is applied to the gate of the transistor Q75 in the differential amplifier circuit 59. The differential amplifier circuit 59 outputs a voltage to the gate of the transistor Q73 which depends on the difference between the division-result voltage and the reference voltage Vref5. The output voltage of the differential amplifier circuit 59 corresponds to a voltage error signal. During the normal mode of operation, the output voltage of the differential amplifier circuit 59, that is, the voltage at the gate of the transistor Q73, changes as the division-result voltage varies relative to the reference voltage Vref5. Thus, in this case, the transistor Q73 operates in a saturation region.

During the normal mode of operation, since the transistor Q74 is held in its sufficiently on state (its fully conductive state), the regulator output current Io is controlled by only the transistor Q73. The resistor R35, the amplifier circuit 56, the differential amplifier circuit 60, and the transistor Q74 compose a feedback loop for providing the constant-current control. During the normal mode of operation, since the transistor Q74 is held in its sufficiently on state, the constant-current control is disabled. The voltage dividing circuit 65, the differential amplifier circuit 59, and the transistor Q73 compose a feedback loop for providing the constant-voltage control. During the normal mode of operation, since the regulator output current Io is controlled by the transistor Q73, the constant-voltage control is active. In this way, during the normal mode of operation, the constant-voltage control is active while the constant-current control is inactive. The constant-voltage control equalizes the regulator output voltage RVo to the command output voltage level V1.

In the case where the resistance RL of the regulator load is smaller than the specific value RL0, operation of the voltage regulator 53 is in an overcurrent protection mode. As previously mentioned, the division-result voltage generated by the voltage dividing circuit 65 is used an indication of the regulator output voltage RVo. During the overcurrent protection mode of operation, the division-result voltage generated by the voltage dividing circuit 65 is lower than the reference voltage Vref5 so that the voltage at the gate of the transistor Q73 (that is, the output voltage of the differential amplifier circuit 59) sufficiently overcomes the threshold voltage related to the transistor Q73. As a result, the transistor Q73 operates in a linear region (an active region), and the voltage between the drain and the source of the transistor Q73 is sufficiently low. In other words, the transistor Q73 is held in a sufficiently on state or a fully conductive state.

As previously mentioned, the detection voltage outputted from the amplifier circuit 56 represents the regulator output current Io. The output voltage of the differential amplifier circuit 60, that is, the voltage at the gate of the transistor Q74, depends on the difference between the detection voltage and the reference voltage Vref6 corresponding to the command limit current level I1. During the overcurrent protection mode of operation, the voltage at the gate of the transistor Q74 changes as the detection voltage outputted from the amplifier circuit 56 varies relative to the reference voltage Vref6. Thus, in this case, the transistor Q74 operates in a saturation region.

During the overcurrent protection mode of operation, since the transistor Q73 is held in its sufficiently on state (its fully conductive state), the regulator output current Io is controlled by only the transistor Q74. As previously mentioned, the resistor R35, the amplifier circuit 56, the differential amplifier circuit 60, and the transistor Q74 compose the feedback loop for providing the constant-current control. During the overcurrent protection mode of operation, since the regulator output current Io is controlled by the transistor Q74, the constant-current control is active. As previously mentioned, the voltage dividing circuit 65, the differential amplifier circuit 59, and the transistor Q73 compose the feedback loop for providing the constant-voltage control. During the overcurrent protection mode of operation, since the transistor Q73 is held in its sufficiently on state, the constant-voltage control is disabled. In this way, during the overcurrent protection mode of operation, the constant-current control is active while the constant-voltage control is inactive. The constant-current control equalizes the regulator output current Io to the command limit current level I1.

Sixth Embodiment

Figure 15:
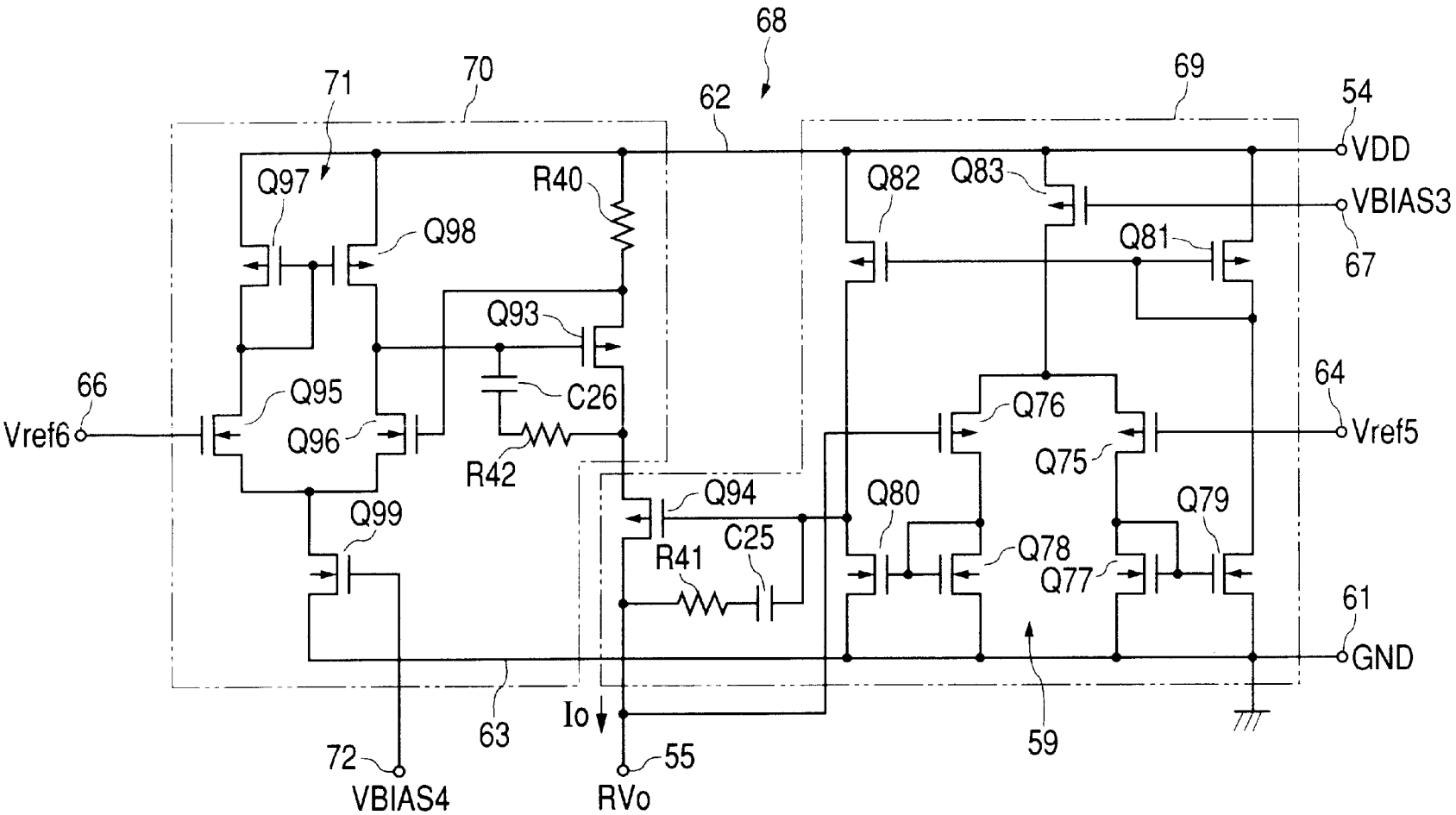
FIG. 15 is a schematic diagram of a voltage regulator according to a sixth embodiment of this invention.

FIG. 15 shows a voltage regulator 68 according to a sixth embodiment of this invention. The voltage regulator 68 is similar to the voltage regulator 53 in FIG. 14 except for design changes mentioned hereafter. The resistor R35 and the amplifier circuit 56 (see FIG. 14) are omitted from the voltage regulator 68.

As shown in FIG. 15, the voltage regulator 68 includes a resistor R40 and MOS transistors Q93 and Q94. The transistors Q93 and Q94 are of a same conductivity type. Specifically, the transistors Q93 and Q94 are of the P-channel type. One end of the resistor R40 is connected with the power-supply input terminal 54 via the power feed line 62. The other end of the resistor R40 is connected with the source of the transistor Q93. The drain of the transistor Q93 is connected with the source of the transistor Q94. The drain of the transistor Q94 is connected with the power-supply output terminal 55. Thus, the resistor R40 and the transistors Q93 and Q94 are connected in series between the power-supply input terminal 54 and the power-supply output terminal 55. The resistor R40 corresponds to a current sensing resistor.

The voltage regulator 68 includes an operational amplifier 69 instead of the operational amplifier 57 (see FIG. 14). The operational amplifier 69 is designed for constant-voltage control. The differential amplifier circuit 59, the transistor Q94, and a phase compensation circuit compose the operational amplifier 69. The transistor Q94 is controlled by the differential amplifier circuit 59. The transistor Q94 corresponds to a first transistor. The gate of the transistor Q94 in the operational amplifier 69 is connected to the output node of the differential amplifier circuit 59, that is, the junction between the drains of the transistors Q80 and Q82. The phase compensation circuit in the operational amplifier 69 includes a series combination of a capacitor C25 and a resistor R41. The series combination of the capacitor C25 and the resistor R41 is connected between the gate and the drain of the transistor Q94.

The voltage regulator 68 includes an operational amplifier 70 instead of the operational amplifier 58 (see FIG. 14). The operational amplifier 70 is designed for constant-current control. The operational amplifier 70 includes a differential amplifier circuit 71 and the transistor Q93. The differential amplifier circuit 71 corresponds to a second amplifier circuit. The differential amplifier circuit 71 has a combination of MOS transistors Q95–Q99. The transistor Q93 is controlled by the differential amplifier circuit 71. The transistor Q93 corresponds to a second transistor.

The structure of the differential amplifier circuit 71 is basically similar to that of the differential amplifier circuit 52 in FIG. 13. In the differential amplifier circuit 71, the transistors Q95 and Q96 are connected to form a differential pair. The gate of the transistor Q95 is connected with the terminal 66 subjected to the reference voltage Vref6. The gate of the transistor Q96 is connected with the junction between the resistor R40 and the source of the output transistor Q93.

In the differential amplifier circuit 71, the transistors Q97 and Q98 form an active load with respect to the differential pair of the transistors Q95 and Q96. The transistor Q97 is connected between the transistor Q95 and the power feed line 62. The transistor Q98 is connected between the transistor Q96 and the power feed line 62. The gates of the transistors Q97 and Q98 are connected to each other. In addition, the gates of the transistors Q97 and Q98 are connected with the drains of the transistors Q95 and Q97.

In the differential amplifier circuit 71, the source of the transistor Q99 is connected with the ground line 63. The drain of the transistor Q99, the source of the transistor Q95, and the source of the transistor Q96 are connected in common. The gate of the transistor Q99 is connected with a terminal 72 subjected to a bias voltage VBIAS4. The gate of the transistor Q93 in the operational amplifier 70 is connected to an output node of the differential amplifier circuit 71, that is, a junction between the drains of the transistors Q96 and Q98. The operational amplifier 70 includes a series combination of a capacitor C26 and a resistor R42 which forms a phase compensation circuit. The series combination of the capacitor C26 and the resistor R42 is connected between the gate and the drain of the transistor Q93.

Operation of the voltage regulator 68 is basically similar to that of the voltage regulator 53 (see FIG. 14). A regulator output current Io flows into a regulator load via the resistor R40, the transistors Q93 and Q94, and the power-supply output terminal 55. A voltage at the junction between the resistor R40 and the source of the transistor Q93 is proportional to the regulator output current Io. The voltage at the junction between the resistor R40 and the source of the transistor Q93 is applied to the gate of the transistor Q96 as a detection voltage indicative of the regulator output current Io. On the other hand, the gate of the transistor Q95 is subjected to the reference voltage Vref6 which corresponds the command limit current level I1. The differential amplifier circuit 71 outputs a voltage to the gate of the transistor Q93 which depends on the difference between the detection voltage and the reference voltage Vref6, that is, the difference between the regulator output current Io and the command limit current level I1.

As previously mentioned, the amplifier circuit 56 (see FIG. 14) is omitted from the voltage regulator 68. Thus, a signal phase delay caused by the amplifier circuit 56 is absent from the voltage regulator 68, and an enhanced stability of the constant-current control is available.

Seventh Embodiment

A seventh embodiment of this invention is a modification of one of the first to sixth embodiments thereof. The seventh embodiment of this invention uses bipolar transistors instead of the MOS transistors in the operational amplifiers 26, 27, 41, 45, 46, 51, 57, 58, 69, and 70. According to the seventh embodiment of this invention, the phase compensation circuits in the operational amplifiers 26, 27, 41, 45, 46, 51, 57, 58, 69, and 70 have structures different from those shown in the drawings.

Eighth Embodiment

An eighth embodiment of this invention is a modification of the first or second embodiment thereof. In the eighth embodiment of this invention, the base of the output transistor Q21 is connected with the drain of the transistor Q37, and the source of the transistor Q37 is connected with the drain of the transistor Q31. The source of the transistor Q31 is connected with the ground line 33. Thus, the connection order of the transistors Q31 and Q37 in the eighth embodiment of this invention is reverse with respect to that in the first or second embodiment thereof.

Ninth Embodiment

A ninth embodiment of this invention is a modification of the third or fourth embodiment thereof. In the ninth embodiment of this invention, the source of the transistor Q57 is connected with the power feed line 32, and the drain of the transistor Q57 is connected with the source of the transistor Q67. The drain of the transistor Q67 is connected with the junction between the resistor R32 and the base of the transistor Q47. Thus, the connection order of the transistors Q57 and Q67 in the ninth embodiment of this invention is reverse with respect to that in the third or fourth embodiment thereof.

Tenth Embodiment

A tenth embodiment of this invention is a modification of the fifth embodiment thereof. In the tenth embodiment of this invention, the source of the transistor Q74 is connected with the power feed line 62, and the drain of the transistor Q74 is connected with the source of the transistor Q73. The drain of the transistor Q73 is connected with one end of the resistor R35. Thus, the connection order of the transistors Q73 and Q74 in the tenth embodiment of this invention is reverse with respect to that in the fifth embodiment thereof.

Eleventh Embodiment

An eleventh embodiment of this invention is a modification of the first or third embodiment thereof. The eleventh embodiment of this invention additionally includes first and second resistors. The first resistor is connected between the power supply terminal 30 and the terminal 37. The second resistor is connected between the terminal 37 and the power supply terminal 31. The first and second resistors compose a voltage dividing circuit for generating the reference voltage Vref2.

Twelfth Embodiment

A twelfth embodiment of this invention is a modification of the fifth or sixth embodiment thereof. The twelfth embodiment of this invention additionally includes first and second resistors. The first resistor is connected between the power-supply input terminal 54 and the terminal 66. The second resistor is connected between the terminal 66 and the power supply terminal 61. The first and second resistors compose a voltage dividing circuit for generating the reference voltage Vref6.

Thirteenth Embodiment

A thirteenth embodiment of this invention is a modification of one of the first to twelfth embodiments thereof. The thirteenth embodiment of this invention includes a constant-voltage circuit for generating the reference voltage Vref2, Vref3, or Vref6. For example, the constant-voltage circuit uses a voltage reference diode which replaces the resistor R30. In this case, since the voltage at the junction between the voltage reference diode and the resistor R31 is held constant, the command limit current level I1 remains constant independent of a fluctuation in the battery voltage Vb.

Fourteenth Embodiment

A fourteenth embodiment of this invention is a modification of one of the first to thirteenth embodiments thereof. In the fourteenth embodiment of this invention, the differential amplifier circuits 28, 29, 42, 48, 52, 59, 60, and 71 are provided with level shift circuits for implementing sufficient drive of the first transistor or the second transistor. For example, a source follower circuit is provided between the gate of the transistor Q68 and the inter-resistor junction in the voltage dividing circuit 40, and a source follower circuit is provided between the gate of the transistor Q69 and the resistor-transistor junction which is the junction between the resistor R29 and the emitter of the output transistor Q21.

Fifteenth Embodiment

Figure 16:
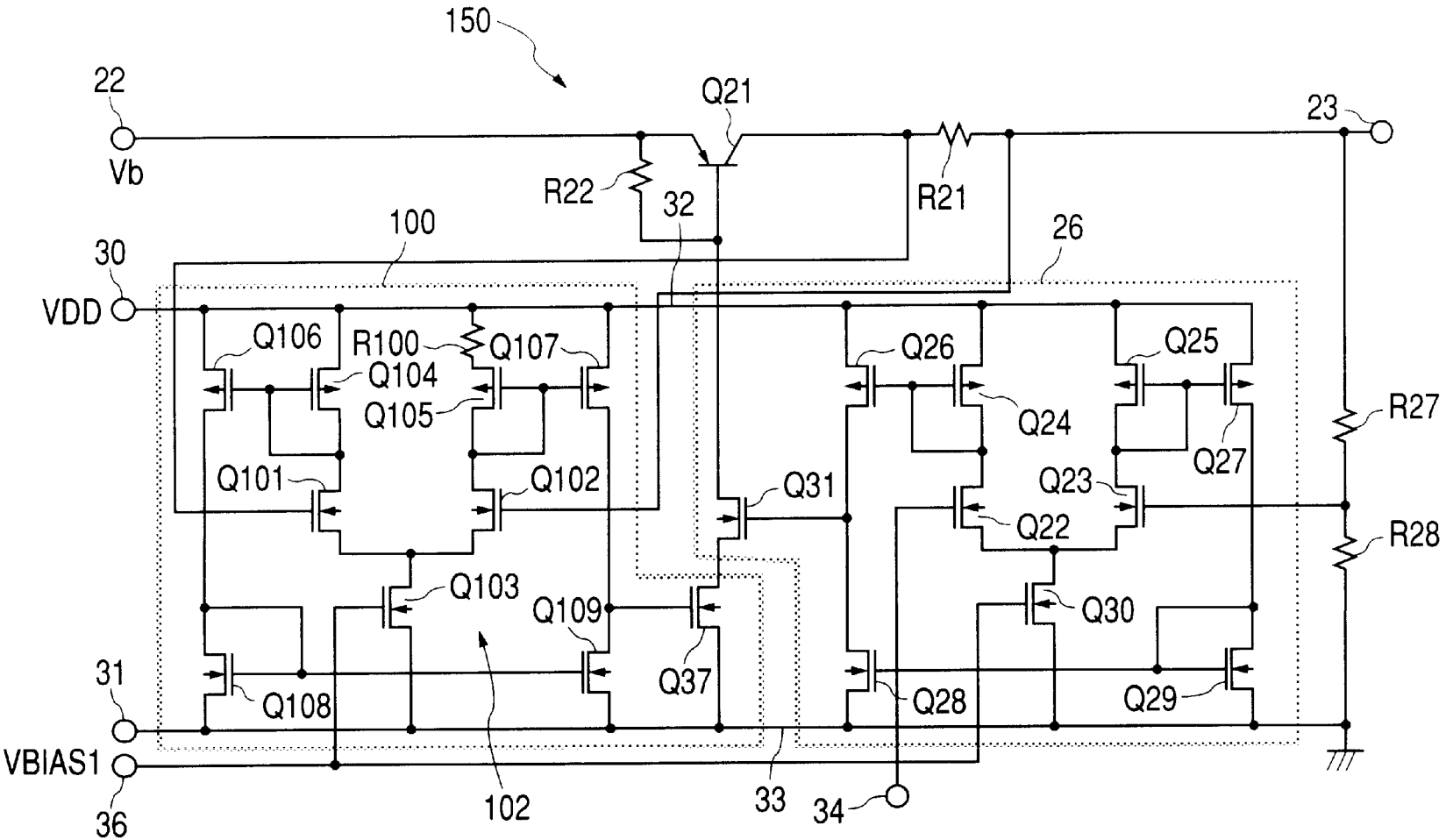
FIG. 16 is a schematic diagram of a voltage regulator according to a fifteenth embodiment of this invention.

FIG. 16 shows a voltage regulator 150 according to a fifteenth embodiment of this invention. The voltage regulator 150 is similar to the voltage regulator 21 in FIG. 6 except for design changes mentioned hereafter.

With reference to FIG. 16, the voltage regulator 150 includes an operational amplifier 100 instead of the combination of the amplifier circuit 24 and the operational amplifier 27 (see FIG. 6). The operational amplifier 100 is designed for constant-current control. The operational amplifier 100 is composed of a differential amplifier circuit 102 and the transistor Q37. The differential amplifier circuit 102 corresponds to a second amplifier circuit. The differential amplifier circuit 102 has a combination of MOS transistors Q101–Q109. The transistor Q37 is controlled by the differential amplifier circuit 102.

The operational amplifier 100 is connected via the power feed line 32 to the positive power supply terminal 30. The operational amplifier 100 is connected via the power feed line (the ground line) 33 to the negative power supply terminal 31. The operational amplifier 100 is activated by the power supply voltage VDD applied between the positive and negative power supply terminals 30 and 31.

In the differential amplifier circuit 102, the transistors Q101 and Q102 are of the N-channel type. The transistors Q101 and Q102 are connected to form a differential pair. The gate of the transistor Q101 is connected with the junction between the resistor R21 and the collector of the output transistor Q21. The gate of the transistor Q102 is connected with the junction between the resistor R21 and the power-supply output terminal 23. Thus, the voltage across the resistor R21 is applied to the differential pair of the transistors Q101 and Q 102.

In the differential amplifier circuit 102, the transistors Q108 and Q109 are of the N-channel type. The transistors Q108 and Q109 form an active load with respect to the differential pair of the transistors Q101 and Q102. The sources of the transistors Q108 and Q109 are connected with the ground line 33. The gates of the transistors Q108 and Q109 are connected to each other. The transistors Q104 and Q106 are of the P-channel type. The transistor Q104 is connected between the power feed line 32 and the transistor Q101. The transistor Q106 is connected between the power feed line 32 and the transistor Q108. The drain of the transistor Q106 is connected with the drain and gate of the transistor Q108. The transistors Q105 and Q107 are of the P-channel type. The source of the transistor Q105 is connected to the power feed line 32 via a resistor RI00. The drain of the transistor Q105 is connected with the drain of the transistor Q102. The transistor Q107 is connected between the power feed line 32 and the transistor Q109. The transistors Q104 and Q106 are connected to form a current mirror circuit. The transistors Q105 and Q107 are connected to form a current mirror circuit.

In the differential amplifier circuit 102, the transistor Q103 is of the N-channel type. The drain of the transistor Q103, the source of the transistor Q101, and the source of the transistor Q102 are connected in common. The gate of the transistor Q103 is connected with the terminal 36 subjected to the bias voltage VBIAS1. The source of the transistor Q103 is connected with the ground line 33. The gate of the transistor Q37 in the operational amplifier 100 is connected to an output node of the differential amplifier circuit 102, that is, a junction between the drains of the transistors Q107 and Q109.

The voltage regulator 150 has an offset voltage provided by the resistor R100. The differential amplifier circuit 102 in the operational amplifier 100 adjusts the conductivity of the transistor Q37 in response to the voltage across the resistor R21 to implement the constant-current control. The constant-current control equalizes the regulator output current Io to a given value (a command limit current level I1) equal to "Vofst/R21", where "Vofst" denotes the offset voltage and "R21" denotes the resistance of the resistor R21. Accordingly, the resistor R100 determines the command limit current level I1. During the execution of the constant-current control, the operational amplifier 100 controls the base current through the output transistor Q21 to reduce the regulator output voltage RVo in accordance with a decrease in the resistance of the regular load.

Sixteenth Embodiment

Figure 17:
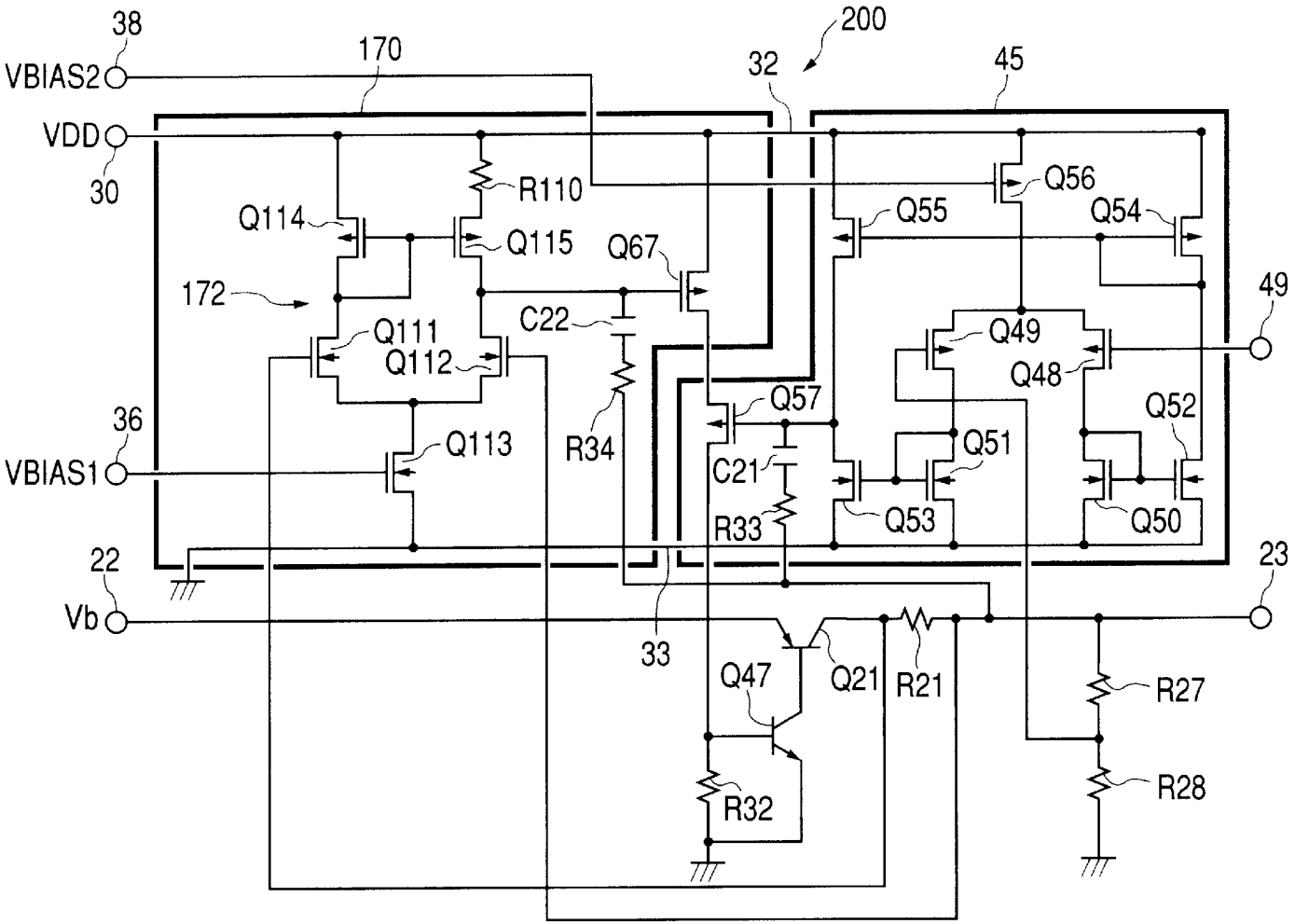
FIG. 17 is a schematic diagram of a voltage regulator according to a sixteenth embodiment of this invention.

FIG. 17 shows a voltage regulator 200 according to a sixteenth embodiment of this invention. The voltage regulator 200 is similar to the voltage regulator 44 in FIG. 12 except for design changes mentioned hereafter.

With reference to FIG. 17, the voltage regulator 200 includes an operational amplifier 170 instead of the combination of the amplifier circuit 24 and the operational amplifier 46 (see FIG. 12). The operational amplifier 170 is designed for constant-current control. The operational amplifier 170 is composed of a differential amplifier circuit 172, the transistor Q67, the capacitor C22, and the resistor R34. The differential amplifier circuit 172 corresponds to a second amplifier circuit. The differential amplifier circuit 172 has a combination of MOS transistors Q111–Q115. The transistor Q67 is controlled by the differential amplifier circuit 172. The capacitor C22 and the resistor R34 are connected in series to form a phase compensation circuit. The series combination of the capacitor C22 and the resistor R34 is connected between the power-supply output terminal 23 and the gate of the transistor Q67.

The operational amplifier 170 is connected via the power feed line 32 to the positive power supply terminal 30. The operational amplifier 170 is connected with the power feed line (the ground line) 33. The operational amplifier 170 is activated by the power supply voltage VDD applied between the positive power supply terminal 30 and the ground line 33.

In the differential amplifier circuit 172, the transistors Q111 and Q112 are of the N-channel type. The transistors Q111 and Q112 are connected to form a differential pair. The gate of the transistor Q111 is connected with the junction between the resistor R21 and the collector of the output transistor Q21. The gate of the transistor Q112 is connected with the junction between the resistor R21 and the power-supply output terminal 23. Thus, the voltage across the resistor R21 is applied to the differential pair of the transistors Q111 and Q112.

In the differential amplifier circuit 172, the transistors Q114 and Q115 are of the P-channel type. The transistors Q114 and Q115 form an active load with respect to the differential pair of the transistors Q111 and Q112. The transistor Q114 is connected between the power feed line 32 and the transistor Q111. The source of the transistor Q115 is connected to the power feed line 32 via a resistor R110. The drain of the transistor Q115 is connected with the drain of the transistor Q112. The transistors Q114 and Q115 are connected to form a current mirror circuit.

In the differential amplifier circuit 172, the transistor Q113 is of the N-channel type. The drain of the transistor Q113, the source of the transistor Q111, and the source of the transistor Q112 are connected in common. The gate of the transistor Q113 is connected with the terminal 36 subjected to the bias voltage VBIAS1. The source of the transistor Q113 is connected with the ground line 33. The gate of the transistor Q67 in the operational amplifier 170 is connected to an output node of the differential amplifier circuit 172, that is, a junction between the drains of the transistors Q112 and Q115.

The voltage regulator 200 has an offset voltage provided by the resistor R110. The differential amplifier circuit 172 in the operational amplifier 170 adjusts the conductivity of the transistor Q67 in response to the voltage across the resistor R21 to implement the constant-current control. The constant-current control equalizes the regulator output current Io to a given value (a command limit current level I1) equal to "Vofst/R21", where "Vofst" denotes the offset voltage and "R21" denotes the resistance of the resistor R21. Accordingly, the resistor R110 determines the command limit current level I1.

The sizes of the transistors Q111 and Q112 may be different from each other to provide an offset voltage. In this case, the resistor R110 can be removed.

What is claimed is:

1. A voltage regulator for converting an input voltage into a regulated voltage equal to a command level, and outputting the regulated voltage, the voltage regulator comprising:

a voltage detection circuit for detecting a regulator output voltage;

a current detection circuit for detecting a regulator output current;

a first amplifier circuit for generating a voltage error signal in response to a command output voltage level indicative of a target value of the regulator output voltage, and in response to the regulator output voltage detected by the voltage detection circuit;

a second amplifier circuit for generating a current limiting signal in response to a command limit current level indicative of a limit value of the regulator output current, and in response to the regulator output current detected by the current detection circuit;

means for controlling the regulator output current in response to a control current;

a first transistor provided in a flow path for the control current, and being driven in response to the voltage error signal generated by the first amplifier circuit; and a second transistor provided in the flow path and connected in series with the first transistor, the second transistor being driven in response to the current limiting signal generated by the second amplifier circuit.

2. A voltage regulator as recited in claim 1, wherein the controlling means comprises a power-supply input terminal, a power-supply output terminal, and an output transistor connected between the power-supply input terminal and the power-supply output terminal, and wherein the flow path includes a flow path for a base current through the output transistor.

3. A voltage regulator as recited in claim 1, wherein the controlling means comprises a power-supply input terminal, a power-supply output terminal, an output transistor connected between the power-supply input terminal and the power-supply output terminal, and a drive transistor for driving the output transistor, and wherein the flow path includes a flow path for a base current through the drive transistor.

4. A voltage regulator as recited in claim 2, wherein the current detection circuit comprises a resistor connected in series with the output transistor.

5. A voltage regulator as recited in claim 4, wherein the second amplifier circuit comprises a differential amplifier circuit having first and second input terminals, the first input terminal receiving a voltage across the resistor, the second input terminal receiving a reference voltage corresponding to the command limit current level.

6. A voltage regulator for converting an input voltage fed to a power-supply input terminal into a regulated voltage equal to a command level, and outputting the regulated voltage via a power-supply output terminal, the voltage regulator comprising:

a voltage detection circuit for detecting a regulator output voltage;

a current detection circuit for detecting a regulator output current;

a first amplifier circuit for generating a voltage error signal in response to a command output voltage level indicative of a target value of the regulator output voltage, and in response to the regulator output voltage detected by the voltage detection circuit;

a second amplifier circuit for generating a current limiting signal in response to a command limit current level indicative of a limit value of the regulator output current, and in response to the regulator output current detected by the current detection circuit;

a current feed path connected between the power-supply input terminal and the power-supply output terminal;

a first transistor provided in the current feed path, and being driven in response to the voltage error signal generated by the first amplifier circuit; and a second transistor provided in the current feed path and being connected in series with the first transistor, the second transistor being driven in response to the current limiting signal generated by the second amplifier circuit.

7. A voltage regulator as recited in claim 6, wherein the current detection circuit comprises a resistor connected in series with the first and second transistors.

8. A voltage regulator as recited in claim 7, wherein the second amplifier circuit comprises a differential amplifier circuit having first and second input terminals, the first input terminal receiving a voltage across the resistor, the second input terminal receiving a reference voltage corresponding to the command limit current level.

9. A voltage regulator as recited in claim 8, further comprising a voltage dividing circuit connected between the power-supply input terminal and a ground terminal for generating the reference voltage.

10. A voltage regulator as recited in claim 5, further comprising a constant-voltage circuit connected with the power-supply input terminal for generating the reference voltage.

11. A voltage regulator as recited in claim 1, wherein the voltage detection circuit comprises a voltage dividing circuit connected between a power-supply output terminal and a ground terminal for generating a division-result voltage, and wherein the first amplifier circuit comprises a differential amplifier circuit having first and second input terminals, the first input terminal receiving the division-result voltage, the second input terminal receiving a reference voltage corresponding to the command output voltage level.

12. A voltage regulator as recited in claim 1, wherein the first and second transistors are of a same conductivity type.

13. A voltage regulator as recited in claim 4, wherein the second amplifier circuit comprises a differential amplifier circuit receiving a voltage across the resistor, and means for generating an offset voltage in the differential amplifier, the offset voltage corresponding to the command limit current level.

14. A voltage regulator comprising:

a power feed line for transmitting electric power toward a load;

an output transistor provided in the power feed line and having a base;

a control line extending from the base of the output transistor for transmitting a base current from the output transistor;

first and second control transistors connected in series and provided in the control line;

first means for detecting a voltage of the electric power transmitted toward the load;

second means for controlling the first control transistor to control the output-transistor base current in response to the voltage detected by the first means;

third means for detecting a current of the electric power transmitted toward the load; and fourth means for controlling the second control transistor to control the output-transistor base current in response to the current detected by the third means.

15. A voltage regulator comprising:

a power feed line for transmitting electric power toward a load;

first and second control transistors connected in series and provided in the power feed line;

first means for detecting a voltage of the electric power transmitted toward the load;

second means for controlling the first control transistor to control the electric power transmitted toward the load in response to the voltage detected by the first means;

third means for detecting a current of the electric power transmitted toward the load; and fourth means for controlling the second control transistor to control the electric power transmitted toward the load in response to the current detected by the third means.

16. A voltage regulator as recited in claim 1, wherein a source-drain path of the first transistor and a source-drain path of the second transistor are connected in series.

17. A voltage regulator as recited in claim 6, wherein a source-drain path of the first transistor and a source-drain path of the second transistor are connected in series.

18. A voltage regulator as recited in claim 14, wherein a source-drain path of the first control transistor and a source-drain path of the second control transistor are connected in series.

19. A voltage regulator as recited in claim 15, wherein a source-drain path of the first control transistor and a source-drain path of the second control transistor are connected in series.

* * * * *